US009989892B2

(12) United States Patent
Takeuchi et al.

(10) Patent No.: US 9,989,892 B2
(45) Date of Patent: Jun. 5, 2018

(54) DEVELOPER ACCOMMODATING CONTAINER WITH PROJECTED SHAPED PORTION FOR CONTACTING TONER SEAL MEMBER

(71) Applicant: CANON KABUSHIKI KAISHA, Tokyo (JP)

(72) Inventors: Toshiaki Takeuchi, Susono (JP); Takashi Kimura, Tokyo (JP); Yoshiyuki Batori, Suntou-gun (JP); Ryuta Murakami, Suntou-gun (JP); Daisuke Makiguchi, Izunokuni (JP); Noritomo Yamaguchi, Kawasaki (JP); Naoki Hayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/348,244

(22) Filed: Nov. 10, 2016

(65) Prior Publication Data

US 2017/0060033 A1 Mar. 2, 2017

Related U.S. Application Data

(62) Division of application No. 15/211,354, filed on Jul. 15, 2016, now Pat. No. 9,523,942, which is a division (Continued)

(30) Foreign Application Priority Data

Sep. 27, 2012 (JP) ..... 2012-213799

(51) Int. Cl.
*G03G 15/08* (2006.01)
*G03G 21/18* (2006.01)

(52) U.S. Cl.
CPC ..... *G03G 15/0898* (2013.01); *G03G 15/0881* (2013.01); *G03G 15/0882* (2013.01); *G03G 21/18* (2013.01)

(58) Field of Classification Search
CPC ..... G03G 15/0881; G03G 15/0882
(Continued)

(56) References Cited

U.S. PATENT DOCUMENTS 4,969,557 A 11/1990 Oka
5,911,096 A 6/1999 Batori et al.
(Continued)

FOREIGN PATENT DOCUMENTS

JP 01-128352 A 9/1989
JP 02-41264 U 3/1990
(Continued)

OTHER PUBLICATIONS

Office Action in Chinese Patent Application No. 201310447382.8, dated Dec. 22, 2015 (with English translation.
(Continued)

*Primary Examiner* — Billy Lactaoen
(74) *Attorney, Agent, or Firm* — Fitzpatrick, Cella, Harper & Scinto

(57) ABSTRACT

A developer accommodating container for accommodating a developer includes: a toner seal member for unsealably sealing an opening of the developer accommodating container; an unsealing member, connected to an end portion of the toner seal member, for unsealing the opening by moving at least a part of the toner seal member; and an auxiliary unsealing member for assisting unsealing by changing a pulling direction of the toner seal member by the unsealing member. The auxiliary unsealing member includes a shaft portion or a projected portion. The shaft portion or the projected portion extends in a longitudinal direction of the developer accommodating container.

16 Claims, 14 Drawing Sheets

Related U.S. Application Data of application No. 14/033,735, filed on Sep. 23, 2013, now Pat. No. 9,465,318.

(58) Field of Classification Search
USPC ..... 399/106, 105, 103, 119, 120, 258, 262, 399/263
See application file for complete search history.

(56) References Cited

U.S. PATENT DOCUMENTS

| | | | |
|---|---|---|---|
| 5,920,753 | A | 7/1999 | Sasaki et al. |
| 5,930,562 | A | 7/1999 | Noda et al. |
| 5,937,237 | A | 8/1999 | Nonaka et al. |
| 5,940,658 | A | 8/1999 | Yokoi et al. |
| 5,991,571 | A | 11/1999 | Yamada et al. |
| 6,075,957 | A | 6/2000 | Batori et al. |
| 6,101,348 | A | 8/2000 | Nonaka et al. |
| 6,131,007 | A | 10/2000 | Yamaguchi et al. |
| 6,275,668 | B1 | 8/2001 | Batori |
| 6,334,035 | B1 | 12/2001 | Abe et al. |
| 6,363,226 | B1 | 3/2002 | Batori |
| 6,400,916 | B1 | 6/2002 | Go et al. |
| 6,453,135 | B1 | 9/2002 | Sameshima et al. |
| 6,714,746 | B2 | 3/2004 | Morioka et al. |
| 6,735,405 | B2 | 5/2004 | Yokoi et al. |
| 6,836,639 | B2 | 12/2004 | Karakama et al. |
| 6,898,392 | B2 | 5/2005 | Karakama et al. |
| 6,937,832 | B2 | 8/2005 | Sato et al. |
| 6,963,706 | B2 | 11/2005 | Morioka et al. |
| 6,987,938 | B2 | 1/2006 | Murakami et al. |
| 7,024,131 | B2 | 4/2006 | Komatsu et al. |
| 7,079,787 | B2 | 7/2006 | Ogino et al. |
| 7,127,192 | B2 | 10/2006 | Batori et al. |
| 7,136,604 | B2 | 11/2006 | Chadani et al. |
| 7,156,797 | B2 | 1/2007 | Komatsu et al. |
| 7,200,349 | B2 | 4/2007 | Sato et al. |
| 7,206,534 | B2 | 4/2007 | Murakami |
| 7,418,225 | B2 | 8/2008 | Morioka et al. |
| 7,885,575 | B2 | 2/2011 | Batori et al. |
| 7,890,019 | B2 | 2/2011 | Tateishi et al. |
| 8,059,989 | B2 | 11/2011 | Tateishi et al. |
| 8,081,898 | B2 | 12/2011 | Batori et al. |
| 8,238,786 | B2 | 8/2012 | Yamaguchi et al. |
| 8,326,185 | B2 | 12/2012 | Asanuma et al. |
| 8,406,656 | B2 | 3/2013 | Batori et al. |
| 8,422,914 | B2 | 4/2013 | Hayashi et al. |
| 8,565,640 | B2 | 10/2013 | Batori et al. |
| 8,620,181 | B2 | 12/2013 | Murakami |
| 2008/0298834 | A1 | 12/2008 | Hasegawa |
| 2009/0169241 | A1* | 7/2009 | Mimura ..... G03G 15/0875 399/106 |
| 2012/0294649 | A1 | 11/2012 | Kikuchi et al. |
| 2014/0072327 | A1 | 3/2014 | Hayashi et al. |
| 2014/0086621 | A1 | 3/2014 | Makiguchi et al. |
| 2014/0086632 | A1 | 3/2014 | Batori et al. |
| 2014/0086633 | A1 | 3/2014 | Batori et al. |
| 2014/0093272 | A1 | 4/2014 | Matsumaru et al. |
| 2014/0105639 | A1 | 4/2014 | Kikuchi et al. |
| 2014/0126928 | A1 | 5/2014 | Batori et al. |

FOREIGN PATENT DOCUMENTS

| | | | |
|---|---|---|---|
| JP | H05-181361 | A | 7/1993 |
| JP | H05-197288 | | 8/1993 |
| JP | H06-95506 | A | 4/1994 |
| JP | H06-124045 | A | 5/1994 |
| JP | 2011-197091 | A | 1/2011 |
| JP | 2012-103287 | A | 5/2012 |

OTHER PUBLICATIONS

Office Action in Japanese Patent Application No. 2012-213799, dated Jun. 21, 2016.
Office Action in Chinese Patent Application No. 201310447382.8, dated Jul. 27, 2016 (with English translation).
Machine translation of Japanese Patent Application Pub. No. H06-124045.

* cited by examiner (a)

(b)

(a)

(b)

(a)

(b)

DEVELOPER ACCOMMODATING CONTAINER WITH PROJECTED SHAPED PORTION FOR CONTACTING TONER SEAL MEMBER

FIELD OF THE INVENTION AND RELATED ART

The present invention relates to a developer accommodating container, a developing cartridge and a process cartridge which are to be provided in an image forming apparatus, and relates to the image forming apparatus.

As a printer, a copying machine, a facsimile machine or the like, the image forming apparatus for forming an image on a sheet material by using an electrophotographic image forming type is used.

Here, the process cartridge refers to a process cartridge prepared by integrally assembling a photosensitive drum and, as a process means, at least one of a charging device, a developing device and a cleaning device into a cartridge. Then, this process cartridge is detachably mounted into a main assembly of the image forming apparatus.

The image forming apparatus using the electrophotographic image forming type forms an electrostatic latent image by subjecting the photosensitive drum, which surface is uniformly electrically charged by a charging means, to selective exposure to light depending on image information. Then, the electrostatic latent image is developed with a toner by a developing means, so that a toner image is formed. Thereafter, the toner image formed on the surface of the photosensitive drum is transferred onto the sheet material to effect image formation.

For example, Japanese Laid-Open Patent Application (JP-A) Hei 5-197288 discloses that a toner supplying opening for permitting communication between a toner chamber and a toner supplying chamber is sealed by using a toner seal member, and then the toner seal member is unsealed by a rotatable member.

The unsealing of the toner seal member is performed by automatically winding up the toner seal member, around the rotatable member, mounted at an end thereof on the rotatable member in the toner chamber. After the unsealing of the toner seal member, the toner seal member is rotated integrally with the rotatable member.

As a result, it is possible to prevent leakage of the toner caused by vibration or impact during transportation of the process cartridge. The toner seal member remains in the process cartridge, and therefore there is no need for a user to treat the toner seal member. Further, there is no need for the user to unseal the toner seal member, and therefore usability (ease of use) is improved.

However, in a constitution of JP-A Hei 5-197288, there was the following problem.

For example, as in a reference example shown in FIG. 15, a toner supplying chamber 28 is provided between a toner chamber 29 provided in a developing container 23 and a toner supplying chamber 28 where a developing roller 32 is provided. Further, of a sealing portion of a toner seal member 52 for sealing the toner supplying opening 28, an upstreammost portion of the toner seal member 52 with respect to an unseal direction V is a sealing portion 24*a*, and a downstreammost portion of the toner seal member 52 with respect to the unsealing direction V is a sealing portion 24*b*.

As shown in (a) of FIG. 15, during peeling of the sealing portion 24*a* of the toner seal member 52, a tangential line of the toner seal member 52 which includes the sealing portion 24*a* as its end point and which contacts an outer peripheral surface 45*b* of a rotatable member 45 is a first rectilinear line L1. Further, on a rectilinear line passing through the sealing portions 24*a* and 24*b*, a rectilinear line which includes the sealing portion 24*a* as its end point and which extends in a direction opposite from the sealing portion 24*b* (in a downward direction of (a) of FIG. 15) is a second rectilinear line L2. Further, a narrower angle of angles formed between the first rectilinear line L1 and the second rectilinear line L2 is θ11.

Further, as shown in (b) of FIG. 15, during the peeling of the sealing portion 24*b* of the toner seal member 52, a tangential line of the toner seal member 52 which includes the sealing portion 24*b* as its end point and which contacts an outer peripheral surface 45*b* of a rotatable member 45 is a fourth rectilinear line L4. Further, on a rectilinear line passing through the sealing portions 24*a* and 24*b*, a rectilinear line which includes the sealing portion 24*b* as its end point and which passes through the sealing portion 24*a* is a fifth rectilinear line L5. Further, a narrower angle of angles formed between the fourth rectilinear line L4 and the fifth rectilinear line L5 is θ21.

Here, in general, when the angles θ11 and θ21 shown in FIG. 15 are increased, the toner seal member 52 can be peeled with a small peeling force. Accordingly, the rotatable member 45 is driven with a minimum force so as to provide a smaller peeling force U for peeling the toner seal member from the sealing portions 24*a* and 24*b*. In that case, there is a need to dispose the rotatable member 45 in a higher position so as to provide larger angles θ11 and θ21 shown in FIG. 15.

However, in the case where the rotatable member 45 is disposed in the higher position so as to provide the larger angles θ11 and θ21 shown in FIG. 15, there is a possibility that a function of the rotatable member 45 as a stirring and feeding member for feeding a toner T from the toner chamber 29 to the toner supplying chamber 28 while stirring the toner T is lowered.

SUMMARY OF THE INVENTION

The present invention has solved the above-described problem, and a principal object of the present invention to provide a developer accommodating container capable of improving a degree of freedom of arrangement of an unsealing member for unsealing an opening by moving a toner seal member.

According to an aspect of the present invention, there is provided a developer accommodating container for accommodating a developer, comprising: a toner seal member for unsealably sealing an opening of the developer accommodating container; an unsealing member, connected to an end portion of the toner seal member, for unsealing the opening by moving at least a part of the toner seal member; and an auxiliary unsealing member for assisting unsealing by changing a pulling direction of the toner seal member by the unsealing member, wherein the auxiliary unsealing member includes a shaft portion or a projected portion, and wherein the shaft portion or the projected portion extends in a longitudinal direction of the developer accommodating container.

These and other objects, features and advantages of the present invention will become more apparent upon a consideration of the following description of the preferred embodiments of the present invention taken in conjunction with the accompanying drawings.

Figure 6:
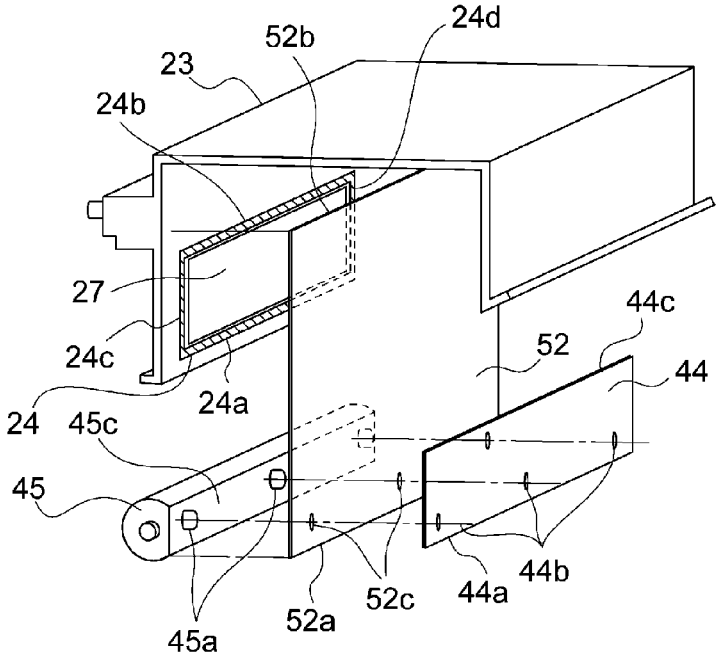
Figure 6:
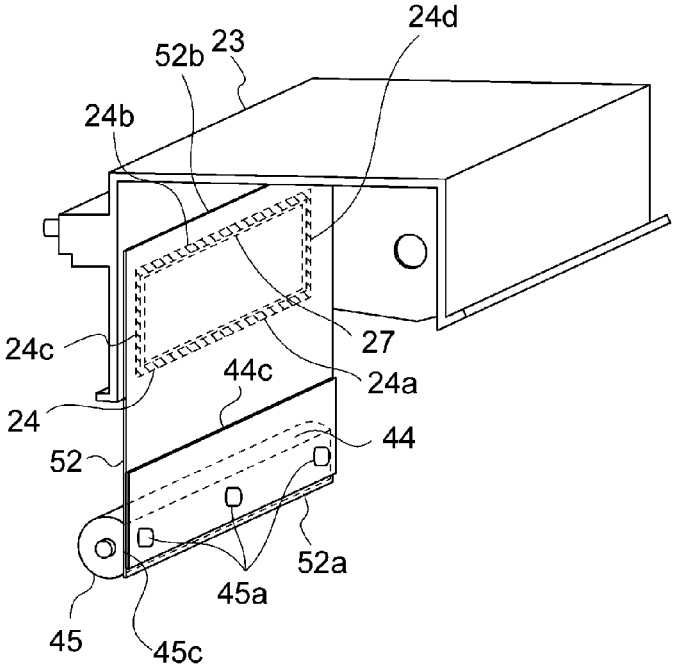

Parts (a) and (b) of FIG. 6 are an exploded perspective view and a perspective illustration, respectively, showing a structure of a sealing portion for sealing an opening by a toner seal member in Embodiment 1.

Figure 7:
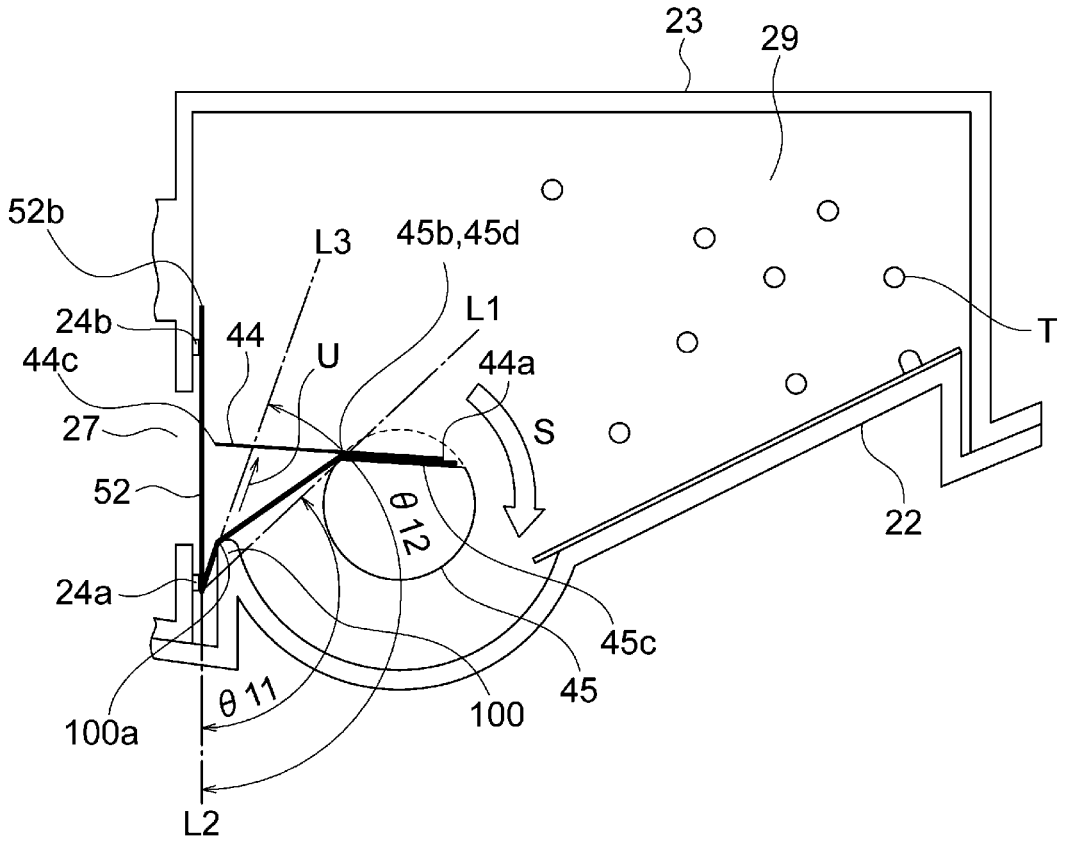

FIG. 7 is a sectional illustration showing a state of the toner seal member during unsealing of the toner seal member in Embodiment 1.

Figure 8:
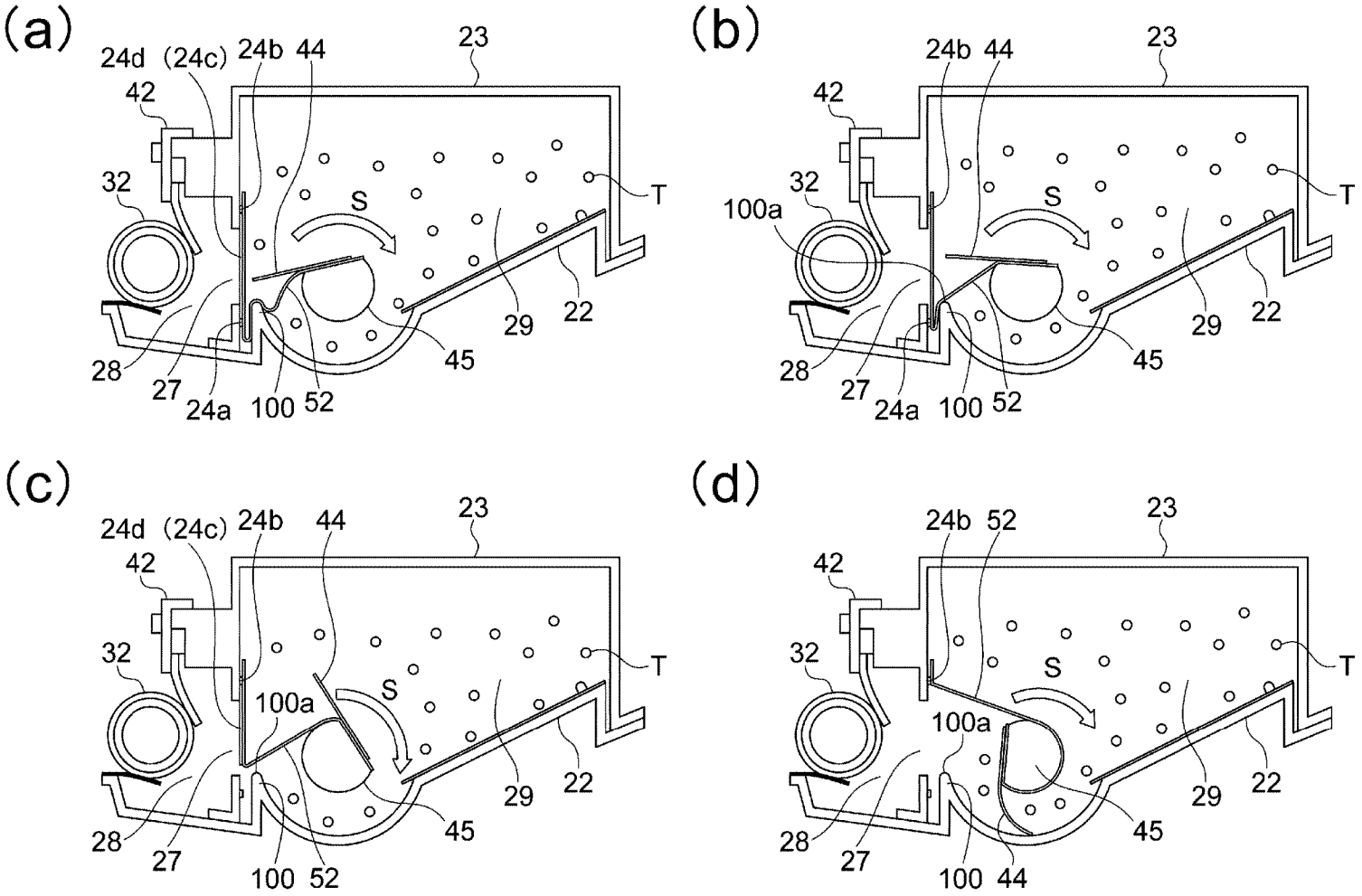

Parts (a) to (d) of FIG. 8 are sectional views for illustrating an unsealing operation of the toner seal member in Embodiment 1.

Figure 9:
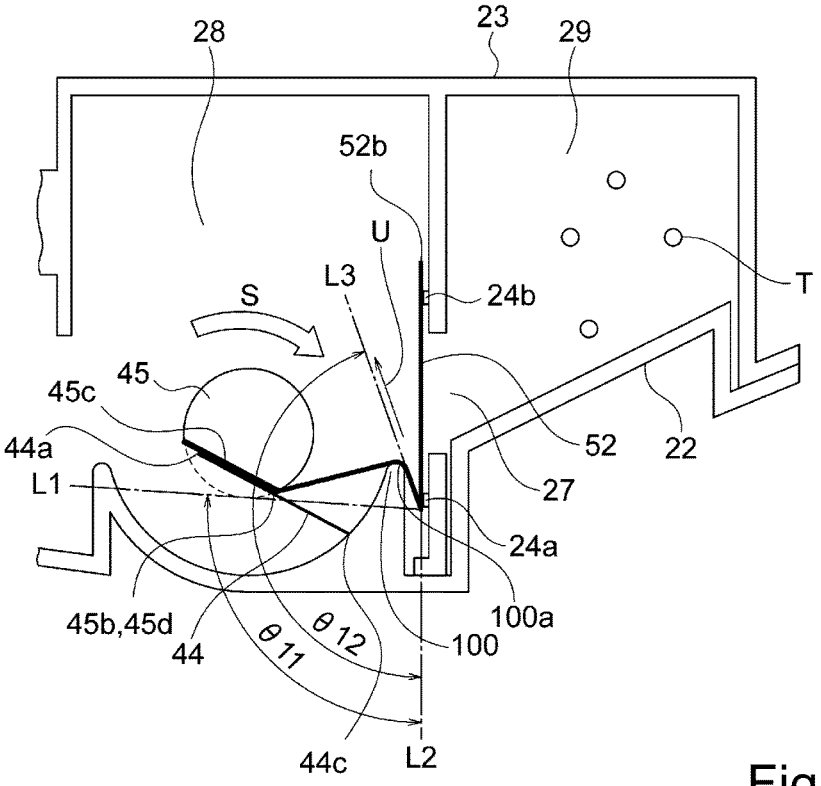

FIG. 9 is a sectional illustration showing a state, during unsealing of a toner seal member, of a process cartridge also functioning as a developing cartridge including a developer accommodating container according to the present invention in Embodiment 2.

Figure 10:
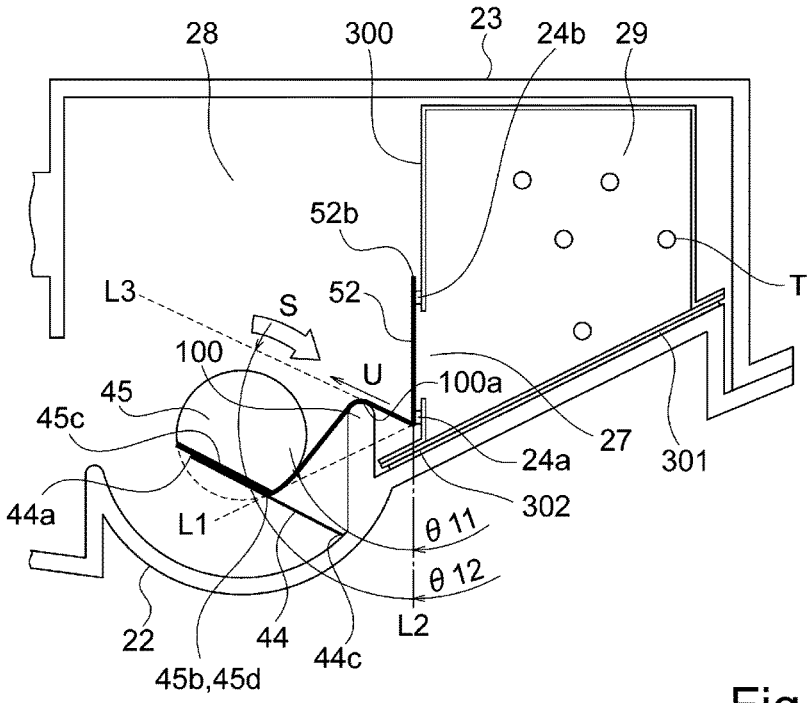

FIG. 10 is a sectional illustration showing a state, during unsealing of a toner seal member, of a process cartridge also functioning as a developing cartridge including a developer accommodating container according to the present invention in Embodiment 3.

Figure 11:
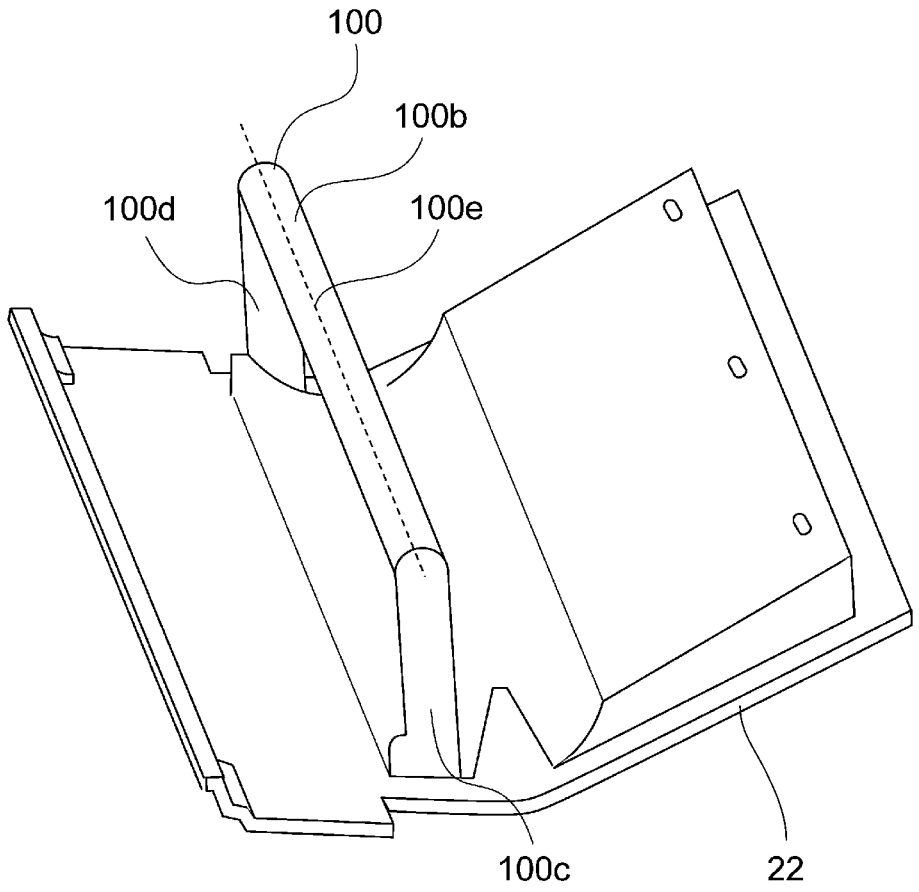

FIG. 11 is a perspective view for illustrating a structure of an auxiliary unsealing member of a process cartridge also functioning as a developing cartridge including a developer accommodating container according to the present invention in Embodiment 4.

Figure 12:
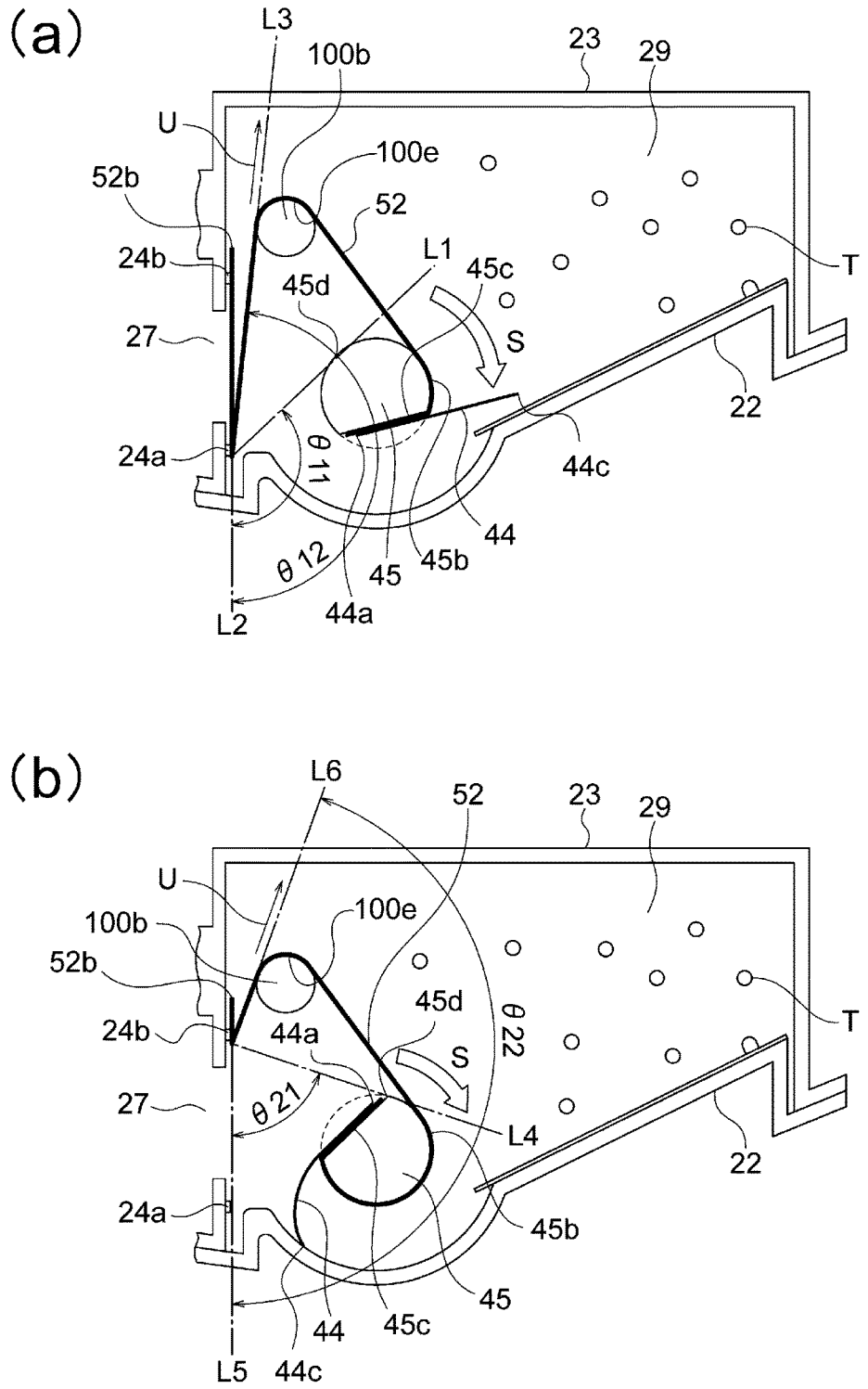

Parts (a) and (b) of FIG. 12 are sectional illustrations showing a state of a toner seal member during unsealing of the toner seal member in Embodiment 4.

Figure 13:
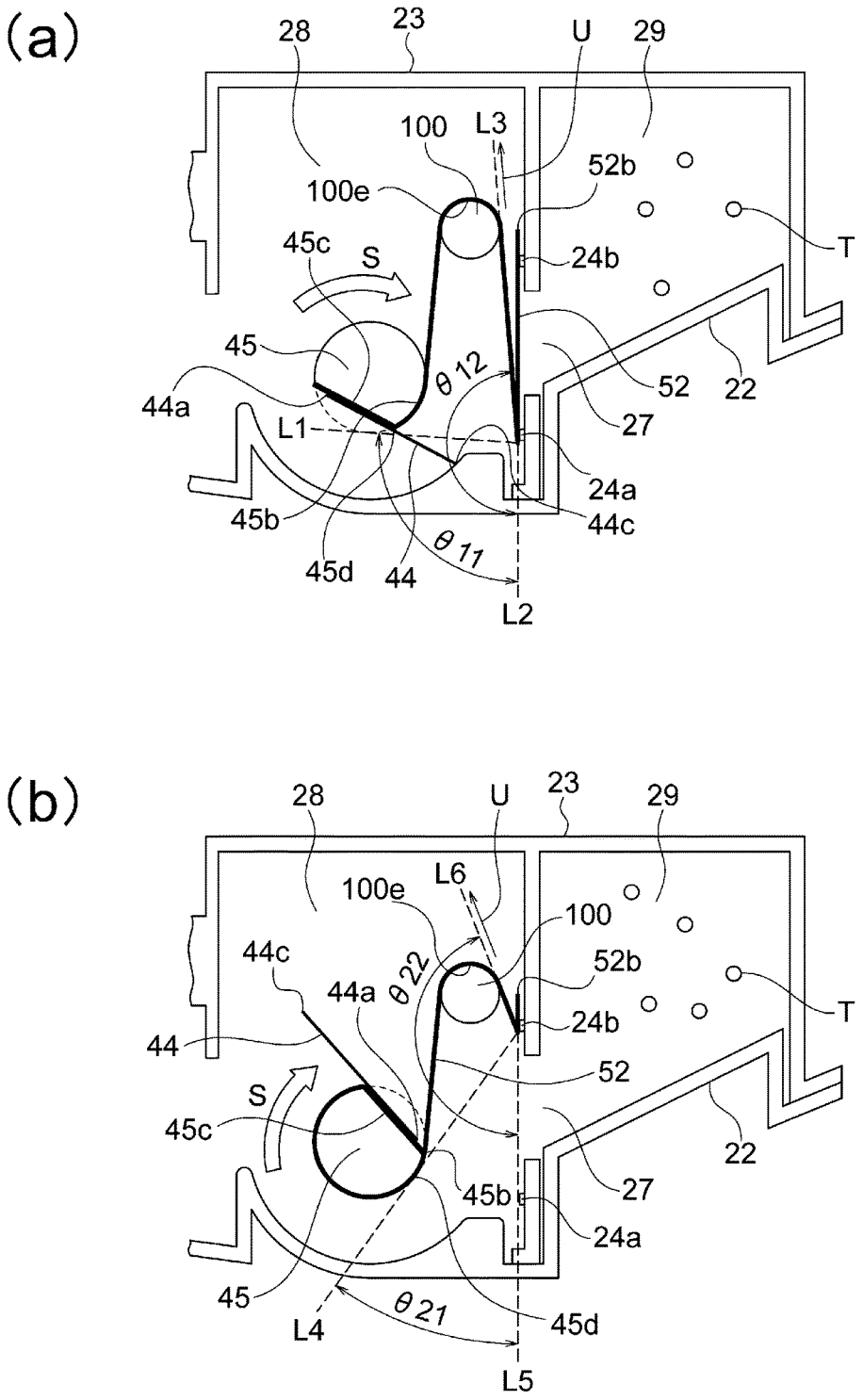

Parts (a) and (b) of FIG. 13 are sectional illustrations showing a state, during unsealing of a toner seal member, of a process cartridge also functioning as a developing cartridge including a developer accommodating container according to the present invention in Embodiment 5.

Figure 14:
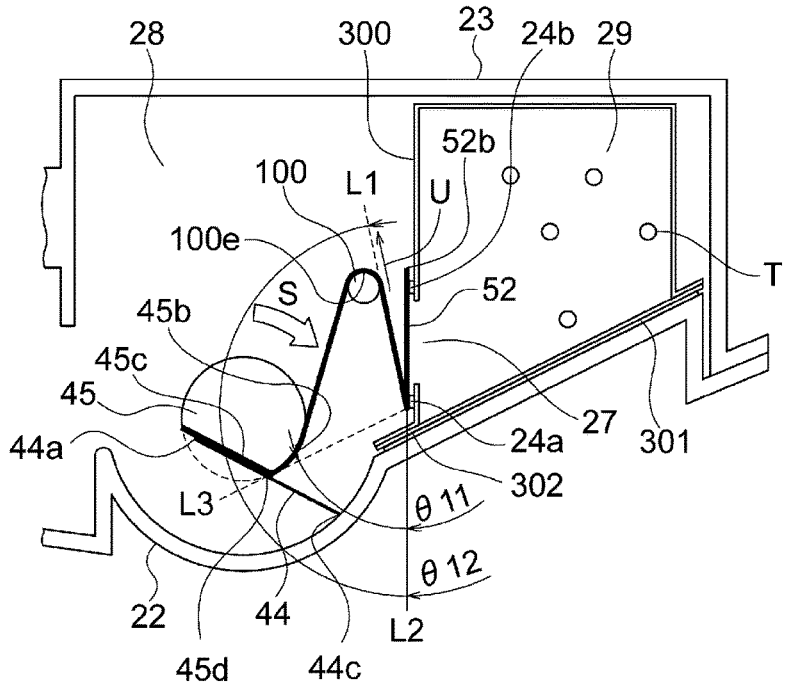
Figure 14:
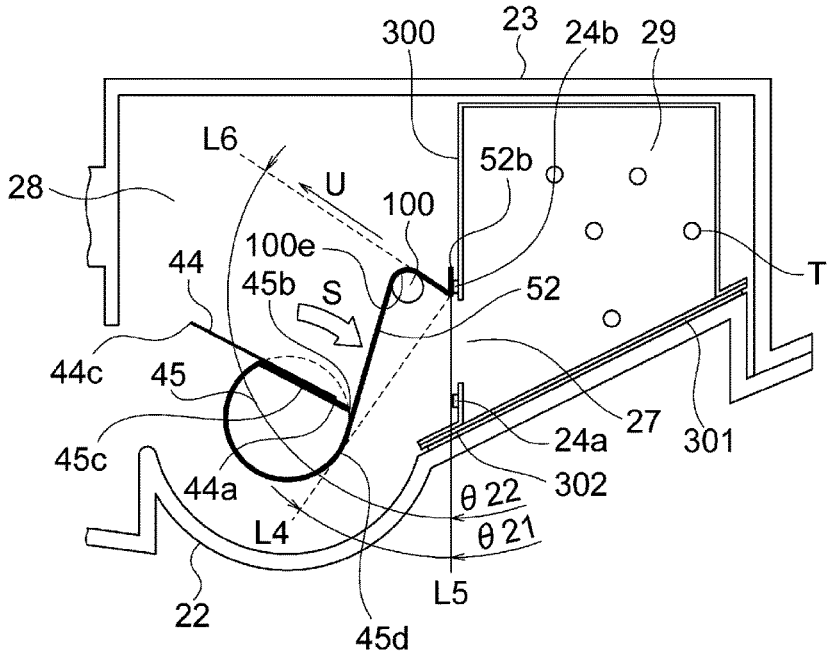

Parts (a) and (b) of FIG. 14 are sectional illustrations showing a state, during unsealing of a toner seal member, of a process cartridge also functioning as a developing cartridge including a developer accommodating container according to the present invention in Embodiment 6.

Figure 15:
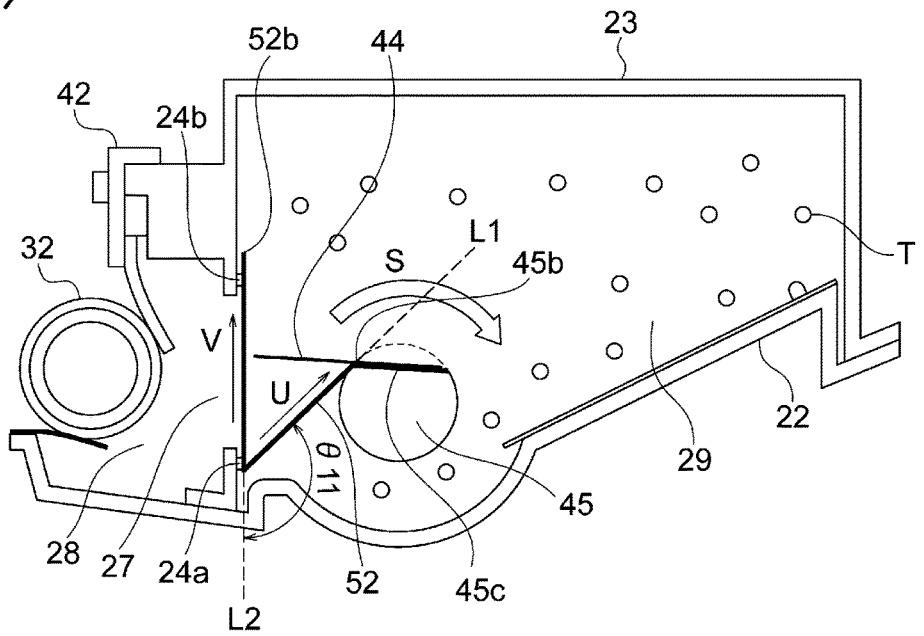
Figure 15:
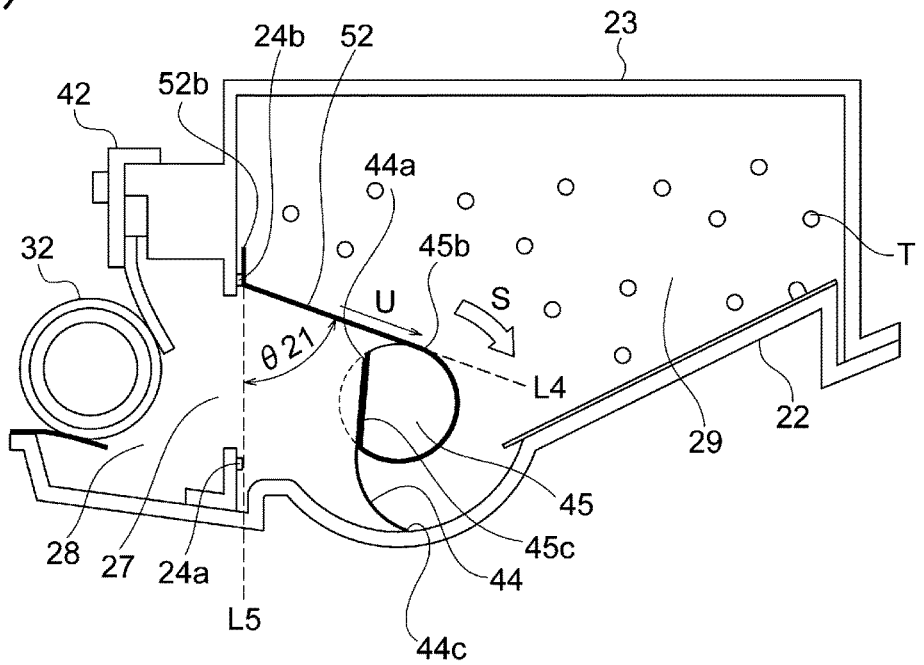

Parts (a) and (b) of FIG. 15 are sectional illustrations showing a state of a toner seal member during unsealing of the toner seal member in a reference example.

Figure 16:
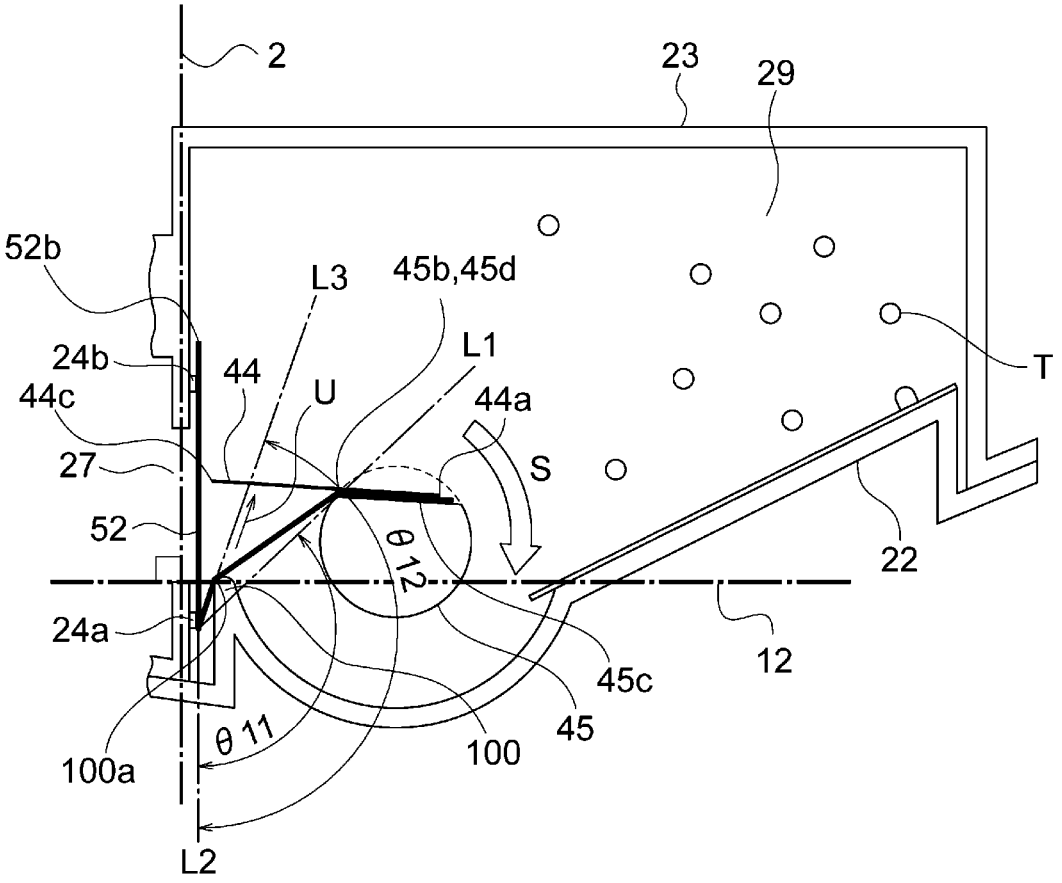

FIG. 16 is a sectional illustration showing a state in which an opening, an auxiliary unsealing member and an unsealing member are located in this order on a line perpendicular to a phantom plane including the opening.

DESCRIPTION OF THE PREFERRED EMBODIMENTS

With reference to the drawings, embodiments of an image forming apparatus in which a process cartridge also functioning as a developing cartridge including a developer accommodating container according to the present invention is provided will be described specifically.

Embodiment 1

First, a structure of the image forming apparatus in which the process cartridge also functioning as the developing cartridge including the developer accommodating container according to the present invention is provided in this embodiment will be described with reference to FIGS. 1 to 18. Incidentally, in the following description, a rotational axis direction (left-right direction in FIG. 3) of a photosensitive drum 62 as an image bearing member for forming an electrostatic latent image on a surface of the photosensitive drum 62 is referred to as a longitudinal direction.

Figure 3:
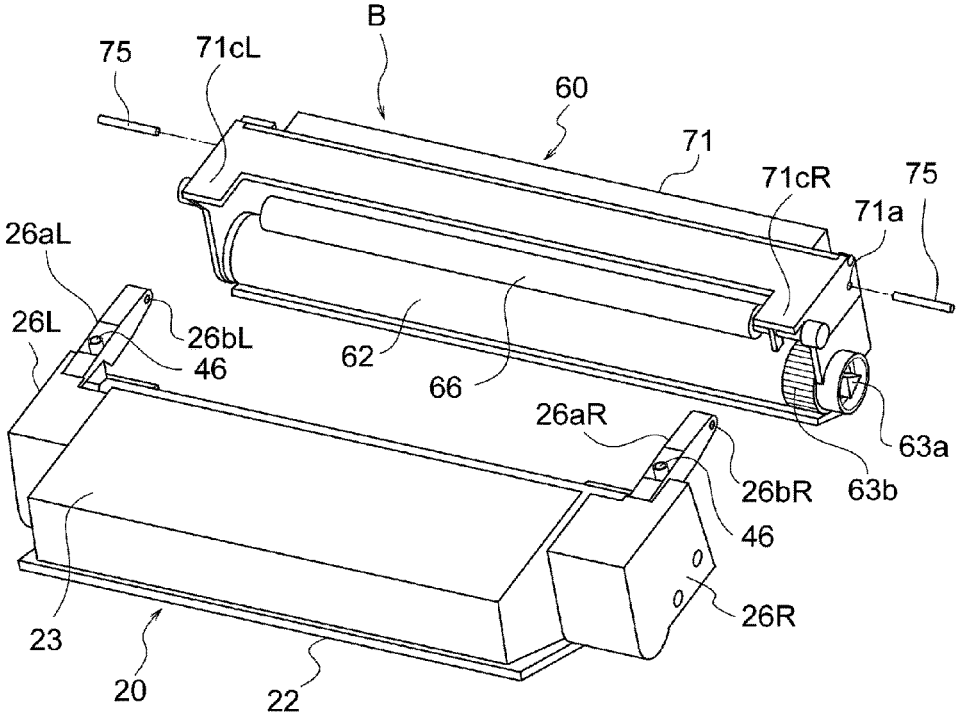
FIG. 3 is an exploded perspective view showing the structure of the process cartridge in Embodiment 1.

Further, with respect to the longitudinal direction of the photosensitive drum 62 shown as the left-right direction in FIG. 3, a side (right side in FIG. 3) where the photosensitive drum 62 receives a driving force from a main assembly of an image forming apparatus A is referred to as a driving side (a driving force receiving portion 63*a* side shown in FIG. 4), and its opposite side is referred to as a non-driving side.

A general structure of the image forming apparatus A and an image forming process will be described with reference to FIGS. 1 and 2.

Figure 1:
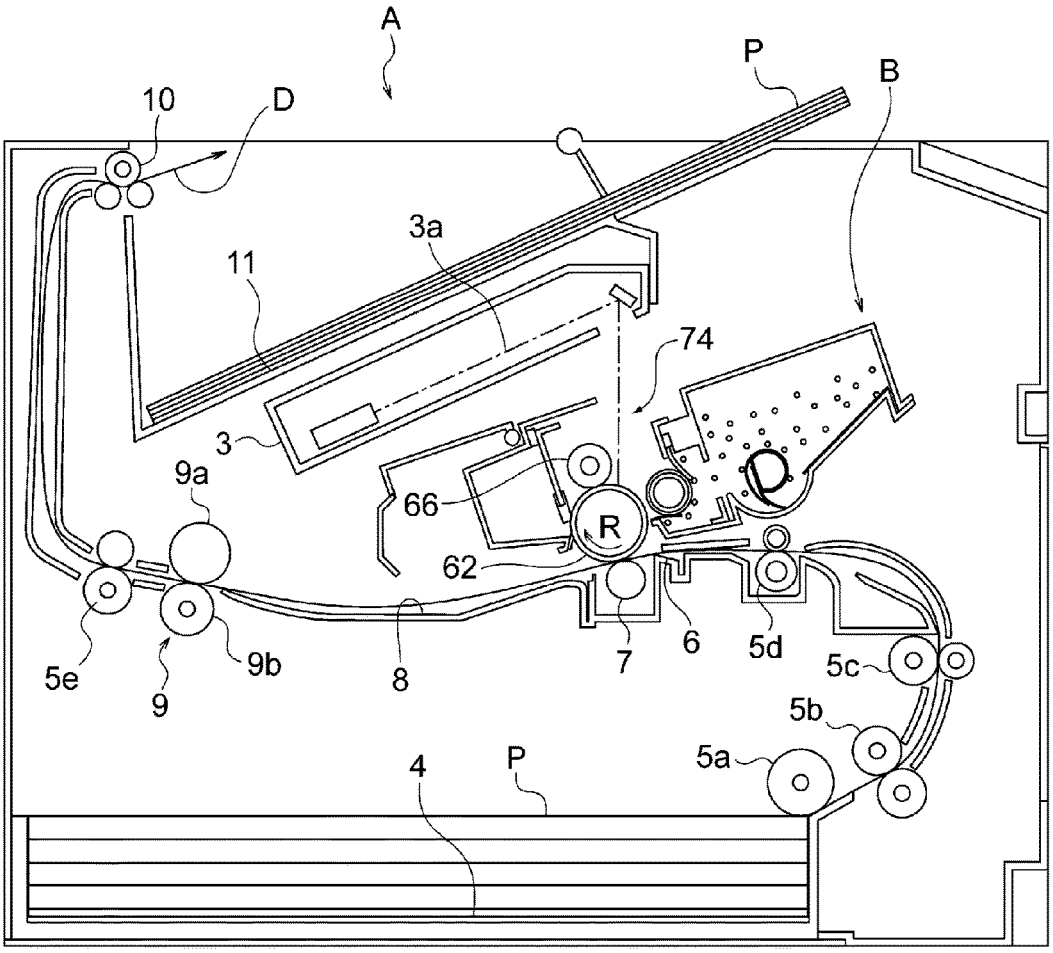
FIG. 1 is a sectional illustration showing a structure of an image forming apparatus in which a process cartridge also functioning as a developing cartridge including a developer accommodating container according to the present invention in Embodiment 1 is provided.

FIG. 1 is a sectional view of a main assembly of the image forming apparatus A and a process cartridge B. FIG. 2 is a sectional view of the cartridge B. Here, the main assembly of the image forming apparatus A refers to a portion of the image forming apparatus A from which the cartridge B is removed.

<General Structure of Image Forming Apparatus>

In FIG. 1, the image forming apparatus A is a laser beam printer, using an electrophotographic type, in which the cartridge B is detachably mountable to the main assembly of the image forming apparatus A. When the cartridge B is mounted in the main assembly of the image forming apparatus A, above the process cartridge B, an exposure device 3 consisting of a laser scanner unit is provided.

Further, below the cartridge B, a sheet (feeding) tray 4 in which a sheet material P to be subjected to image formation is accommodated is provided.

Further, in the main assembly of the image forming apparatus A (in the image forming apparatus main assembly), along a conveyance direction D of the sheet material P, a pick-up roller 5*a*, a feeding roller 5*b*, a conveying roller 5*c*, a registration roller 5*d*, a transfer guide 6, a transfer roller 7 as a transfer means and a conveying guide 8 are provided. Further, a fixing device 9 as a fixing means, a conveying roller 5*e*, a discharging roller 10, a discharge tray 11 and the like are successively provided. Incidentally, the fixing device 9 is constituted by including a heating roller 9*a* and a pressing roller 9*b*.

<Image Forming Process Operation>

Next, an image forming process operation will be described. On the basis of a print start signal, the photosensitive drum 62 is rotationally driven at a predetermined peripheral speed (process speed) in an arrow R direction in FIG. 1.

A charging roller 66 as a charging means to which an unshown charging bias voltage is applied contacts the outer peripheral surface of the photosensitive drum 62 and electrically charges the outer peripheral surface of the photosensitive drum 62 uniformly.

The exposure device 3 as an exposure means outputs laser light 3*a* depending on image information. The laser light 3*a* passes through an exposure window portion 74 provided at an upper surface of the cartridge B, so that the outer peripheral surface of the photosensitive drum 62 is subjected to scanning exposure. As a result, on the outer peripheral surface of the photosensitive drum 62, an electrostatic latent image depending on the image information is formed.

Figure 2:
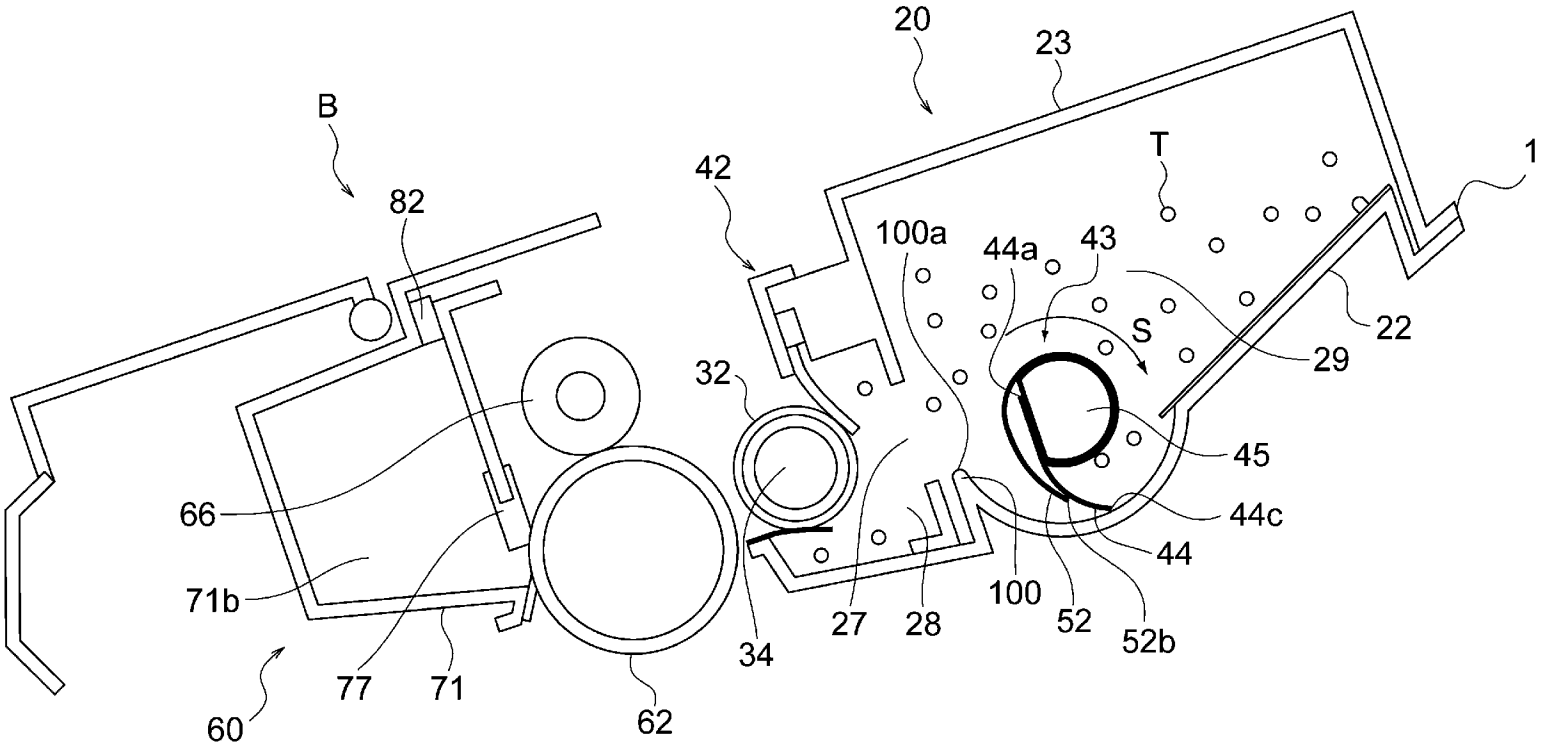
FIG. 2 is a sectional illustration showing a structure of the process cartridge in Embodiment 1.

On the other hand, as shown in FIG. 2, in a developing container 23, as a developer accommodating container for accommodating the toner T as the developer, provided in a developing unit 20 as the developing device, a toner chamber 29 for accommodating the toner T is provided. The toner T in the toner chamber 29 is stirred and fed by rotation of a feeding member 43. Then, the toner T is sent to a toner supplying chamber 28 as a toner chamber outside portion including a rectangular toner supplying opening 27 as an opening communicating with the toner chamber 29.

The sheet member 43*a* is formed in a flexible sheet shape. The sheet member 43*a* is constituted by a material such as polyphenylene sulfide (PPS), polycarbonate (PC) or polyethylene terephthalate (PET). By the integral rotation of the sheet member 43*a* with the feeding member 43, stirring of the toner T in the toner chamber 29 and feeding of the toner T into the toner supplying chamber 28 are effected.

The toner T is carried by a magnetic force of a magnet roller 34 formed with a fixed magnet, on a surface of a developing roller 32 as a developer carrying member for supplying the toner T, in the toner supplying chamber 28 (developer accommodating container) of the developing container 23, to the surface of the photosensitive drum 62.

The toner T carried on the surface of the developing roller 32 is regulated in layer thickness by a developing blade 42 while being triboelectrically charged.

The toner T carried on the developing roller 32 is transferred onto the photosensitive drum 62 depending on the electrostatic latent image formed on the surface of the photosensitive drum 62, so that the electrostatic latent image is visualized as a toner image.

Further, as shown in FIG. 1, in synchronism with output timing of the laser light 3*a*, by the pick-up roller 5*a*, the feeding roller 5*b* and the conveying roller 5*c*, the sheet material P accommodated at a lower portion of the main assembly of the image forming apparatus A is fed and conveyed from the sheet tray 4.

Then, by the registration roller 5*d*, the sheet material P is conveyed, in synchronism with the toner image formed on the surface of the photosensitive drum 62, to a transfer position between the photosensitive drum 62 and the transfer roller 7 via the transfer guide 6. In this transfer position, the toner image formed on the surface of the photosensitive drum 62 is successively transferred onto the sheet material P.

The sheet material P on which the toner image is transferred is separated from the photosensitive drum 62 and then is conveyed to the fixing device 9 along the conveying guide 8. Then, the sheet material P passes through a fixing nip between the heating roller 9*a* and the pressing roller 9*b* which constitute the fixing device 9.

At this fixing nip, fixing by heating and pressure application is effected, so that the toner image is fixed on the sheet material P. The sheet material P on which the toner image is fixed is conveyed to the discharging roller 10 by the conveying roller 5*e* and then is discharged onto the discharge tray 11.

On the other hand, as shown in FIG. 2, the surface of the photosensitive drum 62 after the toner image is transferred onto the sheet material P is, after from which a residual toner is removed by a cleaning blade 77, used again in the image forming process operation. The residual (waste) toner removed from the photosensitive drum 62 is stored in a residual toner chamber 71*b* of a cleaning unit 60.

In the above-described constitution, the charging roller 66, the developing roller 32, and the cleaning blade 77 are the image forming process means actable on the photosensitive drum 62.

<General Structure of Cartridge>

Next, with respect to FIGS. 2, 3 and 5, a general structure of the cartridge B will be described. FIG. 3 is a perspective view for illustrating a structure of the cartridge B. As shown in FIGS. 2 and 3, the cartridge B is constituted by combining the cleaning unit 60 and the developing unit 20. The cleaning unit 60 is constituted by including a cleaning frame 71, the photosensitive drum 62, the charging roller 66, the cleaning blade 77 and the like.

On the other hand, the developing unit 20 is constituted by including the developer container 23, a bottom member 22, (left and right) side members 26L and 26R, a developing blade 42, the developing roller 32, the magnet roller 34, the feeding member 43, the toner T, an urging member 46, and the like.

Then, the cleaning unit 60 and the developing unit 20 are rotationally movably connected with each other by a pin-like connecting member 75 shown in FIG. 3, so that the cartridge B is constituted.

Specifically, the side members 26L and 26R are provided at end portions of the developing unit 20 with respect to a longitudinal direction of the developing unit 20 (a rotational axis direction of the developing roller 32). Further, arm portions 26*a*L and 26*a*R formed on the side members 26L and 26R, respectively, are provided with rotational movement holes 26*b*L and 26*b*R, respectively at their end portions, in parallel to a rotation shaft of the developing roller 3.

Further, at each of longitudinal end portions of the cleaning frame 71, an engaging hole 71*a* for permitting engagement therein of the pin-like connecting member 75 is formed and disposed in parallel to a rotation shaft of the photosensitive drum 62.

Then, the arm portions 26*a*L and 26*a*R are engaged with the cleaning frame 71 at the longitudinal end portions of the cleaning frame 71, and then the connecting members 75 are inserted into the rotational movement holes 26*b*L and 26*b*R and the engaging holes 71*a*, thus being locked. As a result, the cleaning unit 60 and the developing unit 20 are connected with each other rotatably about the connecting members 75.

At this time, urging members 46 mounted at base portions of the arm portions 26*a*L and 26*a*R about against abutment portions 71*c*L and 71*c*R provided at longitudinal end portions of the cleaning frame 71. Further, the urging members 46 urge, by its urging force, the developing unit 20 rotatably about the connecting members 75 toward the cleaning unit 60. As a result, the developing roller 32 is pressed toward the photosensitive drum 62 with reliability.

Figure 5:
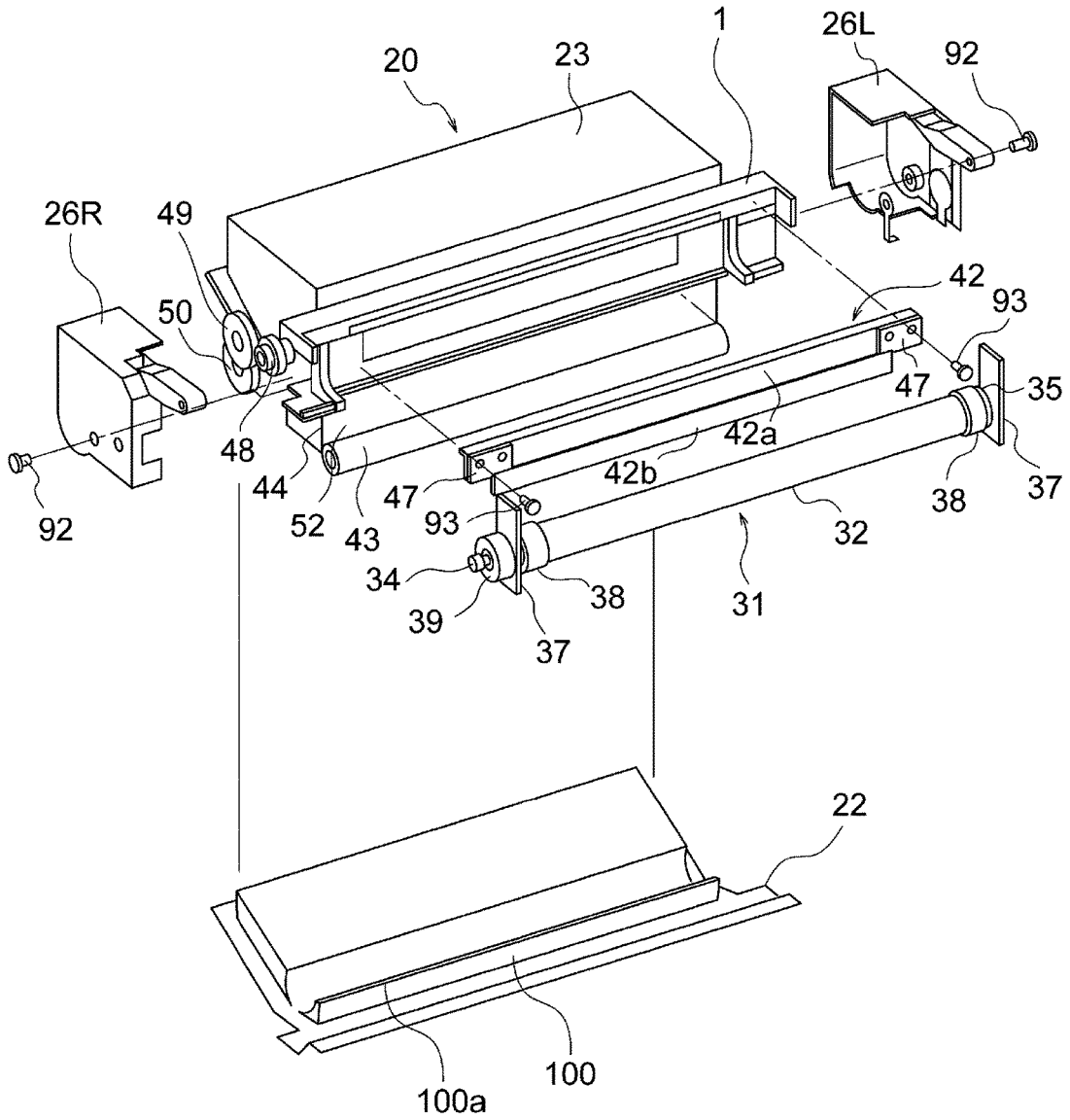
FIG. 5 is an exploded perspective view showing a structure of the developing unit in Embodiment 1.

Then, by a gap (spacing) holding member 38 mounted at each of the end portions of the developing roller 32 with respect to the rotational axis direction of the developing roller 32 shown in FIG. 5, the developing roller 32 is held with a predetermined gap from the photosensitive drum 62.

<Cleaning Unit>

Figure 4:
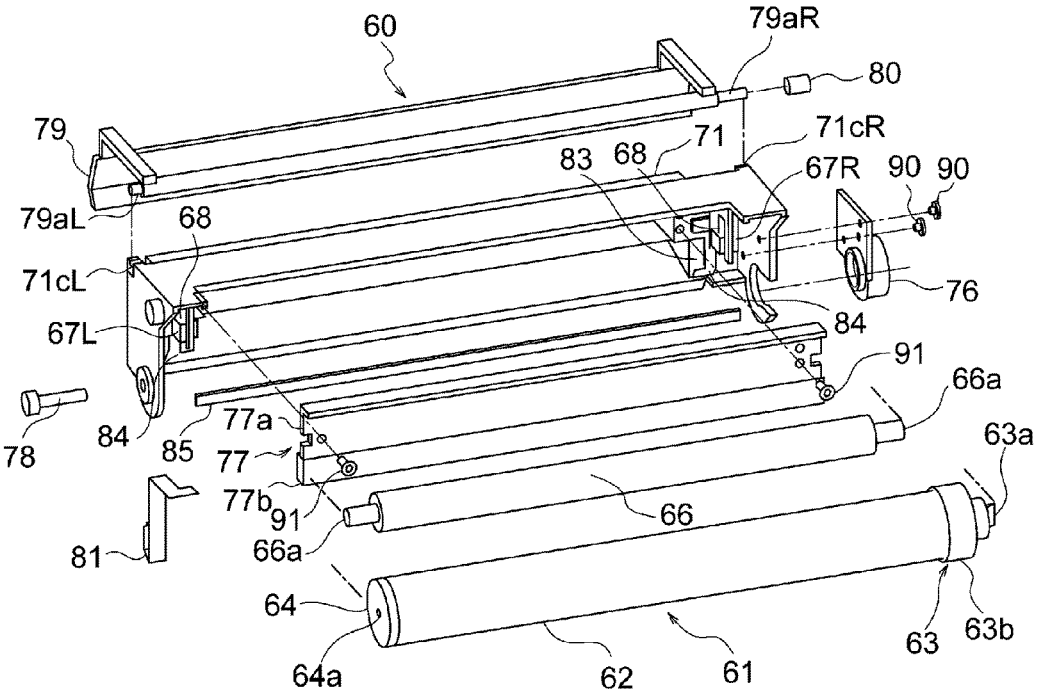
FIG. 4 is an exploded perspective view showing a structure of a cleaning unit in Embodiment 1.

Next, with reference to FIGS. 2 and 4, a structure of the cleaning unit 60 will be described. FIG. 4 is an exploded perspective view for illustrating the structure of the cleaning unit 60.

In FIG. 4, the cleaning unit 60 is constituted by including a supporting member 77*a* formed with a metal plate and an elastic member 77*b* formed of an elastic material such as urethane rubber. Further, the cleaning blade 77 is fixed on the cleaning frame 71 by inserting screws 91 into through holes provided at longitudinal end portions of the supporting member 77*a*, thus being provided in a predetermined position.

The elastic member 77*b* of the cleaning blade 77 contacts the surface of the photosensitive drum 62, so that the residual toner is scraped off and removed from the surface of the photosensitive drum 62.

The residual toner removed from the surface of the photosensitive drum 62 is stored in the residual toner container 71*b* provided in the cleaning unit 60 shown in FIG. 2.

An electrode plate 81, an urging member 68 and charging roller bearings 67L and 67R which are shown in FIG. 4 are mounted on the cleaning frame 71. A rotation shaft 66*a* of the charging roller 66 is rotatably engaged into and supported by the charging roller bearings 67L and 67R.

The charging roller 66 is urged toward the photosensitive drum 62 by the urging member 68, and is rotatably supported by the charging roller bearings 67L and 67R. Then, the charging roller 66 is rotated by rotation of the photosensitive drum 62.

The photosensitive drum 62 is connected integrally with flanges 63 and 64 and thus is constituted as a photosensitive drum unit 61. This connecting method can be performed by using caulking, bonding, welding or the like.

To the flange 64, an unshown grounding contact and the like are connected. Further, the flange 63 includes a driving force receiving portion 63*a* for receiving a driving force from the main assembly of the image forming apparatus A and includes a flange gear portion 63*b* for transmitting the driving force to the developing roller 32.

The bearing member 76 is integrally fixed on the cleaning frame 71 in the driving side, and the drum shaft 78 is press-fitted and fixed in the cleaning frame 71 in the non-driving side. Further, the bearing member 76 is engaged with the flange 63, and a drum shaft 78 is engaged with a hole 64*a* of the flange 64. As a result, the photosensitive drum unit 61 is rotatably supported by the cleaning frame 71.

<Developing Unit>

Next, a structure of the developing unit 20 will be described with reference to FIGS. 2 and 3 to 5. FIG. 5 is an exploded perspective view for illustrating a structure of the developing unit 20.

As shown in FIGS. 2 and 5, a developing (device) frame 1 consisting of the toner developing container 23 and the bottom member 22 defines the toner chamber 29 in which the toner T is accommodated, and the toner supplying chamber 28 which are shown in FIG. 2. The developing container 23 and the bottom member 22 are integrally connected with each other by welding or the like.

The feeding member 43 is constituted by including a feeding sheet 44 and the rotatable member 45. The rotatable member 45 is a rotatable member capable of stirring the toner T in the toner chamber 29 and is constituted as an unsealing member for unsealing the toner supplying opening 27 by moving the toner seal member 52 for unsealably sealing the toner supplying opening 27.

The feeding member 43 is rotatably supported by the developing container 23 in the non-driving side, and is fixed to a feeding gear 50 rotatably mounted in the driving side. As a result, the feeding member 43 is rotated in the toner chamber 29 by the rotation of the feeding gear 50.

The developing blade 42 is constituted by including a supporting member 42*a* formed with a metal plate and including an elastic member 42*b* formed of an elastic material such as an urethane rubber. Further, the developing blade 42 is fixed together with a cleaning member 47 in a predetermined position relative to the developing container 23 by inserting screws 93 into through holes provided at longitudinal end portions of the supporting member 42*a*.

A developing roller unit 31 is constituted by including the developing roller 32, the magnet roller 34, a flange 35, the gap holding member 38, a bearing member 37, a developing roller gear 39 and the like.

From an end portion of the opening in the non-driving side (the right side of FIG. 5), the magnet roller 34 is inserted, and at the opening end portion in the non-driving side, the flange 35 is press-fitted and fixed.

The gap holding member 38 is mounted at each of the end portions of the developing roller 32 with respect to the rotational axis direction of the developing roller 32. Further, outside the gap holding member 38, the bearing member 37 is disposed, and in the driving side (left side of FIG. 5), the developing roller gear 39 is assembled outside the bearing member 37.

By the bearing member 37 disposed at each of the end portions of the developing roller 32 with respect to the rotational axis direction of the developing roller 32, the developing roller 32 is rotatably supported.

Gears 48 and 49 as a drive transmission member are rotatably engaged with the developing frame 1. As a result, the rotational driving force from the main assembly of the image forming apparatus A is received by the driving force receiving portion 63*a* shown in FIG. 3. The driving force received by the driving force receiving portion 63*a* is transmitted to the developing roller 32 and the feeding member 43 by successive engagement and rotation of the flange gear portion 63*b* shown in FIGS. 3 and 4, the developing roller gear 39, the gears 48 and 49, and the feeding gear 50.

As shown in FIG. 5, the side members 26L and 26R are fixed with screws 92 at end portions, respectively, of the developing frame 1 with respect to the longitudinal direction of the developing frame 1. At that time, the bearing members 37 of the developing roller unit 31 are held by the side members 26L and 26R.

<<Toner Seal Member, Auxiliary Unsealing Member and Unsealing Operation>>

<Structure of Toner Seal Member and Auxiliary Unsealing Member>

Next, with reference to FIGS. 6 to 8, a structure of the toner seal member 52 for unsealably sealing the toner supplying opening 27 will be described. Parts (a) and (b) of FIG. 6 are perspective views for illustrating a sealing structure of the toner supplying opening 27 by the toner seal member 52. FIG. 7 is a sectional illustration showing a state of the toner seal member 52 during unsealing of the toner seal member 52. Parts (a) to (d) of FIG. 8 are sectional illustrations showing an unsealing operation of the toner seal member 52.

As shown in FIGS. 6 to 8, the developing container 23 is provided with the toner supplying opening 27 for establishing communication between the toner chamber 29 and the toner supplying chamber 28.

The toner seal member 52 for unsealably sealing the toner supplying opening 27 is constituted by a material compatible with a material for the developing container 23 or a material including an adhesive layer.

The feeding sheet 44 fixed on the rotatable member 45 is formed of a flexible material such as polyethylene terephthalate (PET), polycarbonate (PC) or polyphenylene sulfide (PPS).

As shown in (a) of FIG. 6, an end portion 52*a* of the toner seal member 52 in a fixing side and an end portion 44*a* of the feeding sheet 44 in a fixing side are provided with a plurality of through holes 52*c* and a plurality of through holes 44*b*, respectively. On the other hand, on a flat surface

45*c* of the rotatable member 45 from which a part of a circular shape in cross section is cut away, a plurality of projections 45*a* are provided.

Then, as shown in (a) of FIG. 6, with the projections 45*a*, the through holes 52*a* of the toner seal member 52 and the through holes 44*b* of the feeding sheet 44 are successively engaged. Thereafter, as shown in (b) of FIG. 6, by thermally caulking the projections 45*a* of the rotatable member 45, the toner seal member 52 and the feeding sheet 44 are integrally fixed to the flat surface 45*c* of the rotatable member 45.

Incidentally, a method of fixing the toner seal member 52 and the feeding sheet 44 to the rotatable member 45 may also be another fixing method using welding, snap-fitting, double-side tape or the like, and is not necessarily limited.

Further, in this embodiment, the feeding sheet 44 is provided. For example, a constitution in which stirring of the toner T in the toner chamber 29 and feeding of the toner T to the toner supplying chamber 28 are performed by a part of a rotatable member 45 having a long diameter and a short diameter in cross section or a constitution in which the feeding sheet 44 is not provided may also be employed.

The toner seal member 52 is required to have a length in which the toner seal member 52 can cover the toner supplying opening 27 and is mountable on the rotatable member 45. Here, in order to prevent the end portion 52*b* of the toner seal member 52 from contacting the end portion 44*c* of the feeding sheet 44 after the toner seal member 52 is unsealed, the feeding sheet 44 and the toner seal member 52 have the same mounting phase. That is, as shown in FIG. 7, a constitution in which the toner seal member 52 was wound along an outer peripheral surface of the rotatable member 45 by rotation of the rotatable member 45 in an arrow S direction of FIG. 7 so as not to contact the end portion 55*c* of the feeding sheet 44 was employed.

As an example of this embodiment, by peeling the toner seal member 52 from the toner supplying opening 27, movement of the toner T is enabled through the toner supplying opening 27. However, the present invention is not limited thereto, but there is also an example in which the toner seal member 52 is provided with slits. There is also an example in which when the toner seal member 52 is started to be moved by the rotatable member 45, the slits are pulled and torn to cut and unseal the toner seal member 52. In this case, a portion wound up by the rotatable member 45 is a part of the toner seal member 52, and the remaining toner seal member 52 is in a state in which it is bonded to the sealing portion 24.

In this embodiment, the feeding sheet 44 and the toner seal member 52 are fastened together by caulking of the projections 45*a*. In another example, the feeding sheet 44 and the toner seal member 52 may also be mounted on the rotatable member 45 in different positions.

As shown in (b) of FIG. 6 an open-side end portion 52*b* side of the toner seal member 52, the toner seal member 52 is peelably fixed to the developing container 23 along an opening edge of the toner supplying opening 27 by the thermal welding or the like. This fixed portion is the sealing portion 24. The toner seal member 52 is connected to the first surface 45*c* of the rotatable member 45 at its fixing-side end portion 52*a* in one side via the projections 45*a*, and is provided with the sealing portion 24, for sealing the toner supplying opening 27, at its end portion 52*b* in another side.

Here, a forming method of the sealing portion 24 of the toner seal member 52 on the developing container 23 may also be a method other than the thermal welding or the like, and the sealing portion 24 can also be peelably fixed by, e.g., bonding, laser welding or the like.

As shown in FIG. 6, the sealing portion 24 includes sealing portions 24*a* and 24*b* as a first sealing portion provided in parallel to a rotational axis direction (axial direction) of the rotatable member 45 along the longitudinal direction of the toner supplying opening 27. The sealing portion 24 further includes sealing portions 24*c* and 24*d* as a second sealing portion provided with respect to a direction perpendicular to the rotational axis direction (axial direction) of the rotatable member 45 along a widthwise direction of the toner supplying opening 27.

As shown in FIG. 6, the sealing portions 24*a*, 24*b*, 24*c* and 24*d* are continuously formed in a rectangular shape at an outer peripheral edge portion of the toner supplying opening 27. As a result, it becomes possible to seal the toner T accommodated in the toner chamber 29.

The sealing portion 24*a* as a third sealing portion located upstream of the toner supplying opening 27 with respect to the unsealing direction (in a lower side of FIG. 6) is located in the fixing-side end portion 52*a* side of the toner seal member 52 as seen from the toner supplying opening 27.

On the other hand, the portion 24*b* as a fourth sealing portion located downstream of the toner supplying opening 27 with respect to the unsealing direction (in an upper side of FIG. 6) is located in the open-side end portion 52*a* side of the toner seal member 52 as seen from the toner supplying opening 27.

Further, the sealing portion 24*c* as the second sealing portion is located in the non-driving side, and the sealing portion 24*d* is located in the driving side.

As shown in (a) of FIG. 8, the toner seal member 52 is loosen between the sealing portion 24 thereof and the through holes 52*c* thereof. The sealing portion 24*a* of the toner seal member 52 is peelably fixed on the developing container 23 by the thermal welding or the like. The projections 45*a* projected from the flat surface 45*c* of the rotatable member 45 are injected into the through holes 52*c* of the toner seal member 52.

As a result, even when an external force acts on the rotatable member 45 during assembling and transportation of the cartridge B, the toner seal member 52 is partly loosened and therefore tension is not applied to the toner seal member 52. As a result, a sealing force by the sealing portion 24 is maintained.

<Auxiliary Unsealing Member>

Next, with reference to FIGS. 5, 7 and 8, a structure of an auxiliary unsealing member 100 for changing the pulling direction of the toner seal member 52 by the rotatable member 45 will be described.

As shown in FIGS. 5, 7 and 8, the auxiliary unsealing member 100 is constituted by including a projected shaped portion provided to stand in the neighborhood of the sealing portion 24*a* on the bottom member 22 constituting the developing frame 1. Incidentally, the auxiliary unsealing member 100 is not required to be constituted integrally with the bottom member 22 but may also be constituted as a separate member.

An end portion 100*a* of the auxiliary unsealing member 100 contacts and rubs against the toner seal member 52 during the unsealing of the toner seal member 52 shown in FIG. 7. For this reason, in order to prevent catch, the end portion 100*a* has a moderately curved surface.

The end portion 100*a* of the auxiliary unsealing member 100 in this embodiment is disposed in a position higher than a position of the sealing portion 24*a* f the toner seal member 52. Further, the end portion 100*a* is disposed in a position lower than a position of a phantom contact point 45*d* where the toner seal member 52 contacts the outer peripheral surface of the rotatable member 45 in a state in which there is no auxiliary unsealing member 100 and the toner seal member 52 is stretched along the first rectilinear line L1.

As shown in (a) of FIG. 8, the toner chamber 29 is formed by integrally assembling the developing container 23 with the bottom member 22. Then, the auxiliary unsealing member 100 is disposed in a projected state in the toner chamber 29. In this embodiment, the auxiliary unsealing member 100 and the rotatable member 45 as the unsealing member are provided inside the toner chamber 29. Incidentally, there is no need to provide the auxiliary unsealing member 100 on the bottom member 22, but the auxiliary unsealing member 100 may also be provided to stand in the neighborhood of the sealing portion 24*a* of the developing container 23.

The auxiliary unsealing member 100 opposes the sealing portion 24*a* and is disposed over a substantially full length of the bottom member 22 with respect to the longitudinal direction of the bottom member 22. Here, a constitution in which the auxiliary unsealing member 100 opposes the sealing portion 24*a* and is not disposed over the substantially full length of the bottom member 22 with respect to the longitudinal direction of the bottom member 22 may also be employed. For example, the auxiliary unsealing member 100 may also be provided only in a longitudinal end side of the bottom member 22 or only in longitudinal end sides of the bottom member 22.

<Arrangement of Sealing Portion of Toner Seal Member, Auxiliary Unsealing Member and Rotatable Member>

In this embodiment, arrangement of the sealing portion 24 of the toner seal member 52, the auxiliary unsealing member 100 and the rotatable member 45 is shown in FIG. 7. As shown in FIG. 7, a tangential line of the toner seal member 52 which includes the sealing portion 24*a* as its end point and which contacts an outer peripheral surface of a rotatable member 45 is a first rectilinear line L1. Further, on a rectilinear line passing through the sealing portions 24*a* and 24*b*, a rectilinear line which includes the sealing portion 24*a* as its end point and which extends in a direction opposite from the sealing portion 24*b* (in a downward direction of FIG. 7) is a second rectilinear line L2. Further, a tangential line of the toner seal member which includes the sealing portion 24*a* as its end point and which contacts an outer peripheral surface of the auxiliary unsealing member 100 is a third rectilinear line L3.

In this case, as shown by formula 1 below, a narrower angle θ12 of angles formed between the third rectilinear line L3 and the second rectilinear line L2 is set so as to be larger than a narrower angle θ11 of angles formed between the first rectilinear line L1 and the second rectilinear line L2. The angle θ12 may preferably be designed so as to approach 180 degrees, and therefore the angle θ12 may preferably be 120 degrees to 180 degrees.

$$\text{Angle } \theta 11 < \text{Angle } \theta 12 \qquad \text{(Formula 1)}$$

In order to satisfy a condition represented by formula 1 above, the arrangement of the sealing portion 24 of the toner seal member 52, the auxiliary unsealing member 100 and the rotatable member 45 is constituted as follows. That is, with respect to the horizontal direction (left-right direction) shown in FIG. 7, the end portion 100*a* of the auxiliary unsealing member 100 is disposed between the sealing portion 24*a* of the toner seal member 52 and the rotatable member 45. That is, as shown in FIG. 16, with respect to a line 12 perpendicular to a phantom plane 2 including the toner supplying opening 27, the toner supplying opening 27, the auxiliary unsealing member 100 and the rotatable member 45 (unsealing member) are disposed in this order from left to right. The auxiliary unsealing member 100 is provided in a position closer to the toner supplying opening 27 than the rotatable member 45 (unsealing member).

Further, as in a comparison example shown in (a) of FIG. 15, a state in which there is no auxiliary unsealing member 100 and the toner seal member 52 is stretched along the first rectilinear line L1 between the sealing portion 24*a* of the toner seal member 52 and the phantom contact point 45*d* where the toner seal member 52 contacts the outer peripheral surface of the rotatable member 45 is assumed. In that state, a constitution in which the end portion 100*a* of the auxiliary unsealing member 100 is projected upward (in the upward direction of FIG. 7) from the first rectilinear line L1 connecting the sealing portion 24*a* and the phantom contact point 45*d* may only be employed.

<Unsealing Operation of Toner Seal Member>

Next, an unsealing operation of the toner seal member 52 performed at the time of start of use of the cartridge B will be described with reference to FIGS. 2, 7 and 8. The cartridge B detachably mountable to the main assembly of the image forming apparatus A is mounted in the main assembly of the image forming apparatus A and receives the driving force from the main assembly of the image forming apparatus A, the rotatable member 45 is rotated in an arrow S direction of (a) of FIG. 8.

When the rotatable member 45 is rotated in the arrow S direction of (a) of FIG. 8, the toner seal member 52 is wound up around the outer peripheral surface of the rotatable member 45, and as shown in (b) of FIG. 8, tension is applied to the toner seal member 52 in a state in which the toner seal member 52 contacts the end portion 100*a* of the auxiliary unsealing member 100 along the outer peripheral surface of the end portion 100*a*.

At this time, as shown in FIG. 7, the arrangement of the sealing portion 24 of the toner seal member 52, the auxiliary unsealing member 100 and the rotatable member 45 is as follows. That is, the narrower angle θ12 of the angles formed between the third rectilinear line L3 and the second rectilinear line L2 is set so as to be larger than the narrower angle θ11 of the angles formed between the first rectilinear line L1 and the second rectilinear line L2.

At this time, as shown in FIG. 7, an angle formed between a direction in which a peeling force U for peeling the sealing portion 24*a* of the toner seal member 52 acts and a plane (second rectilinear line L2) including the sealing portions 24 (24*a* to 24*d*) is θ12.

On the other hand, as in the comparison example shown in FIG. 15, the case where the toner seal member 52 is unsealed without providing the auxiliary unsealing member 100 is assumed. In that state, an angle formed between a direction in which a peeling force U for peeling the sealing portion 24*a* of the toner seal member 52 acts and the plane (second rectilinear line L2) including the sealing portions 24 (24*a* to 24*d*) is θ11 (FIG. 7 and (a) of FIG. 15).

Further, as represented by formula 1 above, the condition (Angle θ11<Angle θ12) is satisfied. As a result, in the case where the unsealing is effected via the auxiliary unsealing member 100, the toner seal member 52 can be peeled at the sealing portion 24*a* thereof with a smaller peeling force U than in the case where the unsealing is effected without providing the auxiliary unsealing member 100.

As a result, it is possible to concurrently realize improvement in degree of freedom of the arrangement of the rotatable member 45 and unsealing of the sealing portion 24*a* of the toner seal member 52 with a low load.

Further, the rotatable member 45 is rotated in the arrow S direction of (b) of FIG. 8. Then, as shown in (c) of FIG. 8, the sealing portion 24*a* of the toner seal member 52 is peeled. Thereafter, as shown in (d) of FIG. 8, the sealing portions 24*c* and 24*d* of the toner seal member 52 are continuously peeled. Finally, the sealing portion 24*b* of the toner seal member 52 is continuously peeled.

As a result, as shown in FIG. 2, the toner supplying opening 27 is unsealed, and then the toner seal member 52 is rotated together and integrally with the rotatable member 45 in a state in which the toner seal member 52 is wound up along the outer peripheral surface of the rotatable member 45 rotated in the arrow S direction.

As shown in FIG. 2, the end portion 52*b* of the toner seal member 52 wound up along the outer peripheral surface of the rotatable member 45 is mounted in a length such that the end portion 52*b* is located downstream of the end portion 44*c* of the feeding sheet 44 with respect to the rotational direction of the rotatable member 45 rotated in the arrow S direction of FIG. 2. As a result, there is no obstacle to stirring and feeding functions of the toner T by the feeding sheet 44.

By the feeding member 43 including the feeding sheet 44 which is mounted on the rotatable member 45 rotated in the arrow S direction and which is rotated integrally with the rotatable member 45, the toner T in the toner chamber 29 is supplied to the toner supplying chamber 28, where the developing roller 32 is provided, while being stirred.

Incidentally, in this embodiment, an example in which the developing container 23 as the developer accommodating container 23 is provided as a part of the cartridge B which is the process cartridge detachably mountable to the main assembly of the image forming apparatus A was shown. In another example, it is also possible to employ a constitution in which the developing cartridge which is detachably mountable to the main assembly of the image forming apparatus A and which is constituted by providing the developing roller 32 is provided with the developing container 23 as the developer accommodating container.

Embodiment 2

Next, with reference to FIG. 9, an image forming apparatus in which a process cartridge also functioning as a developing cartridge including a developer accommodating container according to the present invention in a constitution in this embodiment will be described. Incidentally, constituent elements similar to those in Embodiment 1 described above are represented by the same reference numerals or symbols and will be omitted from description.

In Embodiment 1, as shown in FIG. 7, the example in which the auxiliary unsealing member 100 and the rotatable member 45 as the unsealing member were provided inside the toner chamber 29 was described. In this embodiment, as shown in FIG. 9, the auxiliary unsealing member 100 and the rotatable member 45 as the unsealing member are provided outside the toner chamber 29 and inside the toner supplying chamber 28.

FIG. 9 is a sectional illustration showing a state at the time of start of peeling of the sealing portion 24*a* of the toner seal member 52 in this embodiment. Also in the constitution in this embodiment shown in FIG. 9, similarly as in Embodiment 1 described above, the toner seal member 52 is wound up around the outer peripheral surface of the rotatable member 45 in a state in which a part of the toner seal member 52 is pushed upward by the end portion 100*a* of the auxiliary unsealing member 100.

In the constitution in this embodiment, a direction in which a peeling force, along the first rectilinear line L1, for peeling the sealing portion 24*a* of the toner seal member 52 in the case where the toner seal member 52 is wound up in a state in which there is no auxiliary unsealing member 100 acts is assumed. A narrower angle θ11 of angles formed between the direction (first rectilinear line L1) and a plane (second rectilinear line L2) including the sealing portions 24 (24*a* to 24*d*) is considered.

Further, a direction in which a peeling force U, along the third rectilinear line L3, for peeling the sealing portion 24*a* of the toner seal member 52 in the case where the toner seal member 52 is wound up in a state in which the auxiliary unsealing member 100 is provided acts is assumed. A narrower angle θ12 of angles formed between the direction (third rectilinear line L3) and a plane (second rectilinear line L2) including the sealing portions 24 (24*a* to 24*d*) is considered.

In that case, the angle θ12 can be made larger than the angle θ11. As a result, similarly as in Embodiment 1, it is possible to peel the toner seal member 52 with a smaller force.

As a result, it becomes possible to concurrently realize improvement in degree of freedom of the arrangement of the rotatable member 45 and unsealing of the toner seal member with a low load. Other constitutions are the same as those in Embodiment 1 described above, and a similar effect can be obtained.

Embodiment 3

Next, with reference to FIG. 10, an image forming apparatus in which a process cartridge also functioning as a developing cartridge including a developer accommodating container according to the present invention in a constitution in this embodiment will be described. Incidentally, constituent elements similar to those in the embodiments described above are represented by the same reference numerals or symbols and will be omitted from description.

In the above-described embodiments, a constitution in which the toner T was accommodated directly in the developing container was employed. In this embodiment, a constitution in which a flexible container 300 formed of a flexible material was provided inside the developing container 23 and the toner T was accommodated in the flexible container 300 was employed. Further, the flexible container 300 is provided with the toner supplying opening 27 as an opening in the side toward the toner supplying chamber 28, and the toner seal member 52 for unsealably sealing the toner supplying opening 27 is provided.

In the end portion 52*b* side, the toner seal member 52 is fixed peelably at an outer peripheral edge portion of the rectangular toner supplying opening 27 of the flexible container 300 by the sealing portions 24 (24*a* to 24*d*).

FIG. 10 is a sectional illustration showing a state at the time of start of peeling of the sealing portion 24*a* of the toner seal member 52 in this embodiment. Also in this embodiment, similarly as in Embodiment 2 described above, the auxiliary unsealing member 100 and the rotatable member 45 as the unsealing member are disposed outside the toner chamber 29 and inside the toner supplying chamber 28.

Further, the toner chamber 29 is formed by bonding the flexible container 300 and a cap member 301, formed of an air-permeable material, to each other, and is fixed to a fixing portion 302 provided at an inner surface of the bottom member 22.

Also in the constitution in this embodiment shown in FIG. 9, similarly as in the embodiments described above, the toner seal member 52 is wound up around the outer peripheral surface of the rotatable member 45 in a state in which a part of the toner seal member 52 is pushed upward by the end portion 100*a* of the auxiliary unsealing member 100.

In the constitution in this embodiment, a direction in which a peeling force, along the first rectilinear line L1, for peeling the sealing portion 24*a* of the toner seal member 52 in the case where the toner seal member 52 is wound up in a state in which there is no auxiliary unsealing member 100 acts is assumed. A narrower angle θ11 of angles formed between the direction (first rectilinear line L1) and a plane (second rectilinear line L2) including the sealing portions 24 (24*a* to 24*d*) is considered.

Further, a direction in which a peeling force U, along the third rectilinear line L3, for peeling the sealing portion 24*a* of the toner seal member 52 in the case where the toner seal member 52 is wound up in a state in which the auxiliary unsealing member 100 is provided acts is assumed. A narrower angle θ12 of angles formed between the direction (third rectilinear line L3) and a plane (second rectilinear line L2) including the sealing portions 24 (24*a* to 24*d*) is considered.

In that case, the angle θ12 can be made larger than the angle θ11. As a result, similarly as in the above-described embodiments, it is possible to peel the toner seal member 52 with a smaller force.

As a result, it becomes possible to concurrently realize improvement in degree of freedom of the arrangement of the rotatable member 45 and unsealing of the toner seal member with a low load. Other constitutions are the same as those in the embodiments described above, and a similar effect can be obtained.

Embodiment 4

Next, with reference to FIGS. 11 and 12, an image forming apparatus in which a process cartridge also functioning as a developing cartridge including a developer accommodating container according to the present invention in a constitution in this embodiment will be described. Incidentally, constituent elements similar to those in the embodiments described above are represented by the same reference numerals or symbols and will be omitted from description.

In the above-described embodiments, the peeling force U at the time of start of peeling of the sealing portion 24*a* as the third sealing portion located upstream of the toner supplying opening as the opening with respect to the unsealing direction of the toner supplying opening 27 (in the lower side of FIGS. 7, 8, 9 and 10) was reduced by the action of the auxiliary unsealing member 100.

In this embodiment, as shown in (a) and (b) of FIG. 12, a peeling force U at the time of start of peeling of the sealing portion 24*a* as the third sealing portion located upstream of the toner supplying opening as the opening with respect to the unsealing direction of the toner supplying opening 27 (in the lower side of (a) of FIG. 12) is reduced by the action of the auxiliary unsealing member 100. Further, a peeling force U at the time of start of peeling of the sealing portion 24*b* as the fourth sealing portion located downstream of the toner supplying opening as the opening with respect to the unsealing direction of the toner supplying opening 27 (in the upper side of (b) of FIG. 12) is reduced by the action of the auxiliary unsealing member 100. As a result, the peeling forces U at the time of start of peeling of the sealing portions 24*a* and 24*b* are reduced by the auxiliary unsealing member 100. Such a constitution was employed in this embodiment.

FIG. 11 is a perspective illustration showing a structure of the bottom member 22 in this embodiment. Part (a) of FIG. 12 is a sectional illustration showing a state at the time of start of peeling of the sealing portion 24*a* of the toner seal member 52 in this embodiment. Part (b) of FIG. 12 is a sectional illustration showing a state at the time of start of peeling of the sealing portion 24*b* of the toner seal member 52 in this embodiment.

As shown in FIG. 11, in this embodiment, the auxiliary unsealing member 100 for changing the pulling direction of the toner seal member 52 by the rotatable member 45 as the unsealing member is constituted by including a shaft portion 100*b*. The shaft portion 100*b* supported by supporting portions 100*c* and 100*d* which are provided to stand at longitudinal end portions of the bottom member 22. As a cross-sectional shape of the shaft portion 100*b*, other than a cylindrical shape as shown in FIG. 11, a polygonal shape such as a rectangular shape would be considered. Further, the auxiliary unsealing member 100 may also have a structure such as a projected portion in place of the shaft portion 100*b* extending in the longitudinal direction of the developing container 23 (developer accommodating container).

The toner chamber 29 is formed by integrally assembling the developing container 23 with the bottom member 22. As a result, the auxiliary unsealing member 100 is disposed inside the toner chamber 29.

An end portion 100*a* of the auxiliary unsealing member 100 in this embodiment is disposed, as shown in (b) of FIG. 12, in a position higher than a position of the sealing portion 24*a* f the toner seal member 52. Further, the end portion 100*a* is disposed in a position higher than a position of a phantom contact point 45*d* where the toner seal member 52 contacts the outer peripheral surface of the rotatable member 45 in a state in which there is no auxiliary unsealing member 100 and the toner seal member 52 is stretched along the fourth rectilinear line L4.

<Arrangement of Sealing Portion of Toner Seal Member, Auxiliary Unsealing Member and Rotatable Member>

In this embodiment, arrangement of the sealing portion 24 of the toner seal member 52, the auxiliary unsealing member 100 and the rotatable member 45 is shown in (a) and (b) of FIG. 12. As shown in (a) of FIG. 12, a tangential line of the toner seal member 52 which includes the sealing portion 24*a* as its end point and which contacts an outer peripheral surface of a rotatable member 45 is a first rectilinear line L1. Further, on a rectilinear line passing through the sealing portions 24*a* and 24*b*, a rectilinear line which includes the sealing portion 24*a* as its end point and which extends in a direction opposite from the sealing portion 24*b* (in a downward direction of (a) of FIG. 12) is a second rectilinear line L2. Further, a tangential line of the toner seal member which includes the sealing portion 24*a* as its end point and which contacts an outer peripheral surface of the shaft portion 100*b* of the auxiliary unsealing member 100 is a third rectilinear line L3.

In this case, as shown by formula 1 described above, a narrower angle θ12 of angles formed between the third rectilinear line L3 and the second rectilinear line L2 is set so as to be larger than a narrower angle θ11 of angles formed between the first rectilinear line L1 and the second rectilinear line L2. Further, as shown in (b) of FIG. 12, a tangential line of the toner seal member 52 which includes the sealing portion 24*b* as its end point and which contacts an outer peripheral surface of a rotatable member 45 is a fourth rectilinear line L4. The sealing portion 24*b* is the fourth sealing portion disposed downstream of the toner supplying opening 27 as the opening (in the upper side of (b) of FIG. 12). Further, on a rectilinear line passing through the sealing portions 24*a* and 24*b*, a rectilinear line which includes the sealing portion 24*b* as its end point and which passes through the sealing portion 24*a* is a fifth rectilinear line L5. The sealing portion 24*a* is the third sealing portion disposed upstream of the toner supplying opening 27 as the opening (in the lower side of (b) of FIG. 12). Further, a tangential line of the toner seal member 52 which includes the sealing portion 24*b* as its end point and which contacts an outer peripheral surface of the shaft portion 100*b* of the auxiliary unsealing member 100 is a sixth rectilinear line L6.

In this case, as shown by formula 2 below, a narrower angle θ22 of the angles formed between the fifth rectilinear line L5 and the sixth rectilinear line L6 is set so as to be larger than a narrower angle θ21 of angles formed between the fourth rectilinear line L4 and the fifth rectilinear line L5.

$$\text{Angle } \theta 21 < \text{Angle } \theta 22 \qquad \text{(Formula 2)}$$

In order to satisfy a condition represented by formula 2 above, the arrangement of the sealing portion 24 of the toner seal member 52, the auxiliary unsealing member 100 and the rotatable member 45 is constituted as follows. That is, with respect to the horizontal direction (left-right direction) shown in FIG. 12, the shaft portion 100*b* of the auxiliary unsealing member 100 is disposed between the sealing portions 24*a* and 24*b* (as the sealing portion 24) of the toner seal member 52 and the rotatable member 45.

Further, a state in which there is no auxiliary unsealing member 100 and the toner seal member 52 is stretched along the fourth rectilinear line L4, shown in (b) of FIG. 12, between the sealing portion 24*b* of the toner seal member 52 and the phantom contact point 45*d* where the toner seal member 52 contacts the outer peripheral surface of the rotatable member 45 is assumed. In that state, a constitution in which a top end surface 100*e* of the shaft portion 100*b* of the auxiliary unsealing member 100 is projected upward (in the upward direction of (b) of FIG. 12) from the fourth rectilinear line L4 connecting the sealing portion 24*b* and the phantom contact point 45*d* may only be employed.

<Unsealing Operation of Toner Seal Member>

Next, a peeling unsealing operation of the sealing portions 24*a* and 24*b* of the toner seal member 52 will be described with reference to (a) and (b) of FIG. 12.

As shown in (a) of FIG. 12, during peeling of the sealing portion 24*a*, the pulling direction of the toner seal member 52 by the rotatable member 45 is controlled by the top end surface 100*e* of the shaft portion 100*b* of the auxiliary unsealing member 100 so as to satisfy the condition (Angle θ11<Angle θ12) represented by the above-described formula 1.

As a result, with respect to the peeling of the sealing portion 24*a*, in the case where the unsealing is effected via the auxiliary unsealing member 100, the sealing portion 24*a* of the toner seal member 52 can be peeled with a smaller peeling force U than in the case where the unsealing is effected without providing the auxiliary unsealing member 100.

Next, the peeling operation of the sealing portion 24*b* will be described with reference to (b) of FIG. 12. In the case where the sealing portion 24*b* of the toner seal member 52 is unsealed without providing the auxiliary unsealing member 100, a direction in which the peeling force U acts is a direction along the fourth rectilinear line L4 shown in (b) of FIG. 12. In this case, an angle formed between the acting direction of the peeling force U (the direction along the fourth rectilinear line L4) and a plane (the direction along the fifth rectilinear line L5) including the sealing portions 24 (24*a* to 24*d*) is shown by θ21.

As shown in (b) of FIG. 12, during peeling of the sealing portion 24*b*, the pulling direction of the toner seal member 52 by the rotatable member 45 is controlled by the top end surface 100*e* of the shaft portion 100*b* of the auxiliary unsealing member 100 so as to satisfy the condition (Angle θ21<Angle θ22) represented by the above-described formula 2.

As a result, with respect to the peeling of the sealing portion 24*b*, in the case where the unsealing is effected via the auxiliary unsealing member 100, the sealing portion 24*b* of the toner seal member 52 can be peeled with a smaller peeling force U than in the case where the unsealing is effected without providing the auxiliary unsealing member 100.

In this embodiment, with respect to not only the sealing portions 24*a* and 24*b* but also the sealing portions 24*c* and 24*d* which are continuously located between these sealing portions 24*a* and 24*b* with respect to a direction perpendicular to the rotational axis direction of the rotatable member 45, the auxiliary unsealing member 100 is similarly provided. As a result, the toner seal member 52 can be peeled with a smaller peeling force U. That is, at the entire sealing portion 24, it is possible to peel the toner seal member 52 with the smaller peeling force U.

As a result, it becomes possible to concurrently realize improvement in degree of freedom of the arrangement of the rotatable member 45 and unsealing of the toner seal member with a low load. Other constitutions are the same as those in the embodiments described above, and a similar effect can be obtained.

Embodiment 5

Next, with reference to FIG. 13, an image forming apparatus in which a process cartridge also functioning as a developing cartridge including a developer accommodating container according to the present invention in a constitution in this embodiment will be described. Incidentally, constituent elements similar to those in the embodiments described above are represented by the same reference numerals or symbols and will be omitted from description.

In Embodiment 4, the constitution in which the toner seal member 52, the sealing portion 24, the auxiliary unsealing member 100 and the rotatable member 45 were provided inside the toner chamber 29 was employed. In this embodiment, a constitution in which the toner seal member 52, the sealing portion 24, the auxiliary unsealing member 100 and the rotatable member 45 are provided outside the toner chamber 29 and inside the toner supplying chamber 28 is employed.

Part (a) of FIG. 13 is a sectional illustration showing a state at the time of start of peeling of the sealing portion 24*a* of the toner seal member 52.

Part (b) of FIG. 13 is a sectional illustration showing a state at the time of start of peeling of the sealing portion 24*b* of the toner seal member 52.

Also in the constitution in this embodiment, similarly as in Embodiment 4 described above, the toner seal member 52 is wound up by the rotatable member 45 via the auxiliary unsealing member 100.

As a result, it is possible to peel the toner seal member 52 with a smaller peeling force U than in the case where the toner seal member 52 is wound up by the rotatable member 45 in a state in which there is no auxiliary unsealing member 100.

As a result, it becomes possible to concurrently realize improvement in degree of freedom of the arrangement of the rotatable member 45 and unsealing of the toner seal member with a low load. Other constitutions are the same as those in the embodiments described above, and a similar effect can be obtained.

Embodiment 6

Next, with reference to FIG. 14*q*, an image forming apparatus in which a process cartridge also functioning as a developing cartridge including a developer accommodating container according to the present invention in a constitution in this embodiment will be described. Incidentally, constituent elements similar to those in the embodiments described above are represented by the same reference numerals or symbols and will be omitted from description.

In the above-described Embodiment 5, a constitution in which the toner T was accommodated directly in the developing container was employed. In this embodiment, similarly as in the above-described Embodiment 3, a constitution in which a flexible container 300 formed of a flexible material was provided inside the developing container 23 and the toner T was accommodated in the flexible container 300 was employed. Further, the flexible container 300 is provided with the toner supplying opening 27 as an opening in the side toward the toner supplying chamber 28, and the toner seal member 52 for unsealably sealing the toner supplying opening 27 is provided. Other portions or members are constituted similarly as in the above-described Embodiment 5.

Part (a) of FIG. 14 is a sectional illustration showing a state at the time of start of peeling of the sealing portion 24*a* of the toner seal member 52.

Part (b) of FIG. 14 is a sectional illustration showing a state at the time of start of peeling of the sealing portion 24*b* of the toner seal member 52.

As shown in FIG. 14, the toner chamber 29 is formed by bonding the flexible container 300, formed of the flexible material, and a cap member 301, formed of an air-permeable material, to each other. The toner chamber 29 is fixed by a fixing portion 302 provided at an inner peripheral surface of the bottom member 22.

Also in the constitution in this embodiment, by winding up the toner seal member 52 by the rotatable member 45 via the auxiliary unsealing member 100, it is possible to peel the toner seal member 52 with a smaller peeling force U than in the case where the toner seal member 52 is wound up by the rotatable member 45 in a state in which there is no auxiliary unsealing member 100.

As a result, it becomes possible to concurrently realize improvement in degree of freedom of the arrangement of the rotatable member 45 and unsealing of the toner seal member with a low load. Other constitutions are the same as those in the embodiments described above, and a similar effect can be obtained.

According to the above-described constitutions of the present invention, by providing the auxiliary unsealing member, it is possible to improve the degree of freedom of the arrangement of the unsealing member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 213799/2012 filed Sep. 27, 2012, which is hereby incorporated by reference.

What is claimed is:

1. A developer accommodating container comprising:

a frame provided with a developer chamber for accommodating developer and an opening for permitting discharge of the developer from said developer chamber;

a toner seal member for unsealably sealing the opening;

a rotatable member for unsealing the opening by moving said toner seal member, said rotatable member being provided inside of said developer chamber; and a projected shaped portion provided inside of said developer chamber and formed on said frame, wherein said projected shaped portion has a curved surface at a free end portion thereof, wherein said toner seal member includes a fixed portion connected to said rotatable member at one end portion, and said toner seal member includes a sealing portion for sealing the opening at another end portion, and wherein said toner seal member is contactable to said curved surface of said projected shaped portion between said fixed portion and said sealing portion when said toner seal member is unsealed.

2. A developer accommodating container according to claim 1, wherein said projected shaped portion extends in a longitudinal direction of said developer accommodating container.

3. A developer accommodating container according to claim 1, wherein said fixed portion is a plurality of holes.

4. A developer accommodating container according to claim 3, wherein said rotatable member includes a plurality of projections for fixing the plurality of holes.

5. A developer accommodating container according to claim 1, further comprising a feeding sheet for feeding the developer and fixed to said rotational member, wherein said fixed portion is sandwiched between said rotatable member and said feeding sheet.

6. A developer accommodating container according to claim 1, wherein said sealing portion includes (i) one end side sealing portion positioned at a first side of the opening and (ii) another end side sealing portion positioned at a second side of the opening that is opposite to the first side of the opening.

7. A developer accommodating container according to claim 6, wherein a position of said one end side sealing portion is lower than a position of the top of said projected shaped portion in a state in which a cartridge including the developer accommodating container is mounted in a main assembly of an image forming apparatus.

8. A developer accommodating container according to claim 7, wherein, when said one end side sealing portion is unsealed, a direction of an unsealing force for unsealing said one end side sealing portion is a direction from said one end side sealing portion to a side of said another end side sealing portion.

9. A developer accommodating container according to claim 8, wherein if (i) a tangential line which includes said one end side sealing portion as its end point and which contacts an outer peripheral surface of said projected shaped portion is a first tangential line, and (ii) a tangential line which includes said one end side sealing portion as its end point and which contacts an outer peripheral surface of said rotatable member is a second tangential line, then said rotatable member and said projected shaped portion are arranged such that the first tangential line is located at a side of the opening with respect to the second tangential line.

10. A developing cartridge detachably mountable to a main assembly of an image forming apparatus, the developing cartridge comprising:

a developer accommodating container according to claim 1; and a developer carrying member for supplying developer in said developer accommodating container to a surface of an image bearing member on which an electrostatic latent image is to be formed.

11. A process cartridge detachably mountable to a main assembly of an image forming apparatus, the process cartridge comprising:

a developer accommodating container according to claim 1;

an image bearing member on which an electrostatic latent image is to be formed; and a developer carrying member for supplying developer in said developer accommodating container to a surface of said image bearing member.

12. A developing device comprising:

a developer carrying member configured to carry developer;

a frame including (i) a developing chamber that includes said developer carrying member and (ii) an accommodating chamber that includes developer, said accommodating chamber being provided with an opening configured to permit discharge of the developer to said developing chamber; and a developer feeding member provided in said accommodating chamber and configured to discharge the developer accommodated in said accommodating chamber through the opening by rotation thereof, wherein said developer feeding member includes:

a rotatable member, a developer feeding sheet fixed to said rotatable member and having a feeding surface configured to feed the developer accommodated in said accommodating chamber through the opening by rotation of said rotatable member, and a sealing sheet including one end portion fixed to said rotatable member and the other end portion provided to seal the opening, said sealing sheet being configured to open the opening by the rotation of said rotatable member, wherein, when said sealing sheet is wound about said rotatable member and when a free end of said sealing sheet with respect to a perpendicular direction perpendicular to a rotational axis of said rotatable member contacts said developer feeding sheet, said feeding surface of said developer feeding sheet is exposed in a portion between a free end of said developer feeding sheet with respect to the perpendicular direction and a contact portion where said developer feeding sheet contacts said free end of said sealing sheet.

13. A developing device according to claim 12, wherein said feeding surface scoops the developer and causes the developer to pass through the opening while thrusting the scooped developer and then feeds the scooped developer to said developer carrying member.

14. A developing device according to claim 12, wherein said sealing sheet includes (i) a fixed portion connected to said rotatable member at one end portion and (ii) a sealing portion configured to seal the opening at another end portion, wherein said sealing portion includes (i) one end side sealing portion positioned at a first side of the opening and (ii) another end side sealing portion positioned at a second side of the opening that is opposite to the first side of the opening, and wherein, when said one end side sealing portion is unsealed, a direction of an unsealing force for unsealing said one end side sealing portion is a direction from said one end side sealing portion to the side of said another end side sealing portion.

15. A developer container comprising:

an accommodating chamber including developer and provided with an opening configured to permit discharge of the developer; and a developer feeding member configured to discharge the developer accommodated in said accommodating chamber into a developing chamber through the opening by rotation thereof, wherein said developer feeding member includes:

a rotatable member, a developer feeding sheet fixed to said rotatable member and having a feeding surface configured to feed the developer accommodated in said chamber into said developing chamber through the opening by rotation of said rotatable member, and a sealing sheet including one end portion fixed to said rotatable member and the other end portion provided to seal the opening, said sealing sheet being configured to open the opening by the rotation of said rotatable member, wherein, when said sealing sheet is wound about said rotatable member and when a free end of said sealing sheet with respect to a perpendicular direction perpendicular to a rotational axis of said rotatable member contacts said developer feeding sheet, said feeding surface of said developer feeding sheet is exposed in a portion between a free end of said developer feeding sheet with respect to the perpendicular direction and a contact portion where said developer feeding sheet contacts said free end side of said sealing sheet.

16. A developing device according to claim 15, wherein said sealing sheet includes (i) a fixed portion connected to said rotatable member at one end portion and (ii) a sealing portion configured to seal the opening at another end portion, wherein said sealing portion includes (i) one end side sealing portion positioned at a first side of the opening and (ii) another end side sealing portion positioned at a second side of the opening that is opposite to the first side of the opening, and wherein, when said one end side sealing portion is unsealed, a direction of an unsealing force for unsealing said one end side sealing portion is a direction from said one end side sealing portion to the side of said another end side sealing portion.

* * * * *